US011427949B2

(12) United States Patent
Han et al.

(10) Patent No.: US 11,427,949 B2
(45) Date of Patent: Aug. 30, 2022

(54) WASHING MACHINE

(71) Applicant: SAMSUNG ELECTRONICS CO., LTD., Suwon-si (KR)

(72) Inventors: Ju Bum Han, Seoul (KR); Dong Ha Jung, Yongin-si (KR); Jeong Hoon Kang, Seoul (KR); Kwan Woo Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 108 days.

(21) Appl. No.: 16/933,533

(22) Filed: Jul. 20, 2020

(65) Prior Publication Data

US 2020/0347537 A1 Nov. 5, 2020

Related U.S. Application Data

(63) Continuation of application No. 15/813,514, filed on Nov. 15, 2017, now Pat. No. 10,760,195.

(30) Foreign Application Priority Data

Nov. 21, 2016 (KR) ..... 10-2016-0155231
Apr. 12, 2017 (KR) ..... 10-2017-0047447

(51) Int. Cl.

| | |
|---|---|
| ***D06F 37/26*** | (2006.01) |
| ***D06F 37/24*** | (2006.01) |
| ***D06F 23/04*** | (2006.01) |
| ***D06F 37/12*** | (2006.01) |
| ***D06F 37/20*** | (2006.01) |

(52) U.S. Cl.
CPC ..... *D06F 37/268* (2013.01); *D06F 23/04* (2013.01); *D06F 37/12* (2013.01); *D06F 37/20* (2013.01); *D06F 37/24* (2013.01)

(58) Field of Classification Search
CPC ..... D06F 23/04; D06F 37/12; D06F 37/20; D06F 37/24; D06F 37/268
See application file for complete search history.

(56) References Cited

U.S. PATENT DOCUMENTS 3,021,956 A 2/1962 Bochan
4,625,529 A 12/1986 Anderson
(Continued)

FOREIGN PATENT DOCUMENTS

KR 0117588 7/1998
KR 20-0320745 7/2003
(Continued)

OTHER PUBLICATIONS

International Search Report dated Mar. 8, 2018, in corresponding International Patent Application No. PCT/KR2017/012929.
(Continued)

*Primary Examiner* — Joseph L. Perrin
(74) *Attorney, Agent, or Firm* — Staas & Halsey LLP

(57) ABSTRACT

A washing machine includes a cabinet; a tub disposed in the inside of the cabinet; at least one suspension apparatus configured to reduce vibrations of the tub, and to connect the tub to the cabinet such that the tub is supported on the cabinet; and a position guide apparatus having one end connected to the at least one suspension apparatus, and the other end connected to the tub, and configured to limit a movement range in horizontal direction of the tub.

17 Claims, 39 Drawing Sheets

(56) References Cited

U.S. PATENT DOCUMENTS

| | | | | |
|---|---|---|---|---|
| 2007/0039359 | A1 | 2/2007 | Lee et al. | |
| 2007/0256458 | A1 | 11/2007 | Jang et al. | |
| 2008/0229517 | A1 | 9/2008 | Amarillas | |
| 2010/0294006 | A1 | 11/2010 | Tebaldi | |
| 2011/0167878 | A1 | 7/2011 | De Angelo Sanchez et al. | |
| 2012/0056517 | A1 | 3/2012 | Noh et al. | |
| 2014/0060120 | A1 | 3/2014 | Yu | |
| 2015/0020551 | A1* | 1/2015 | Yu | D06F 37/24 68/23.3 |
| 2015/0184325 | A1 | 7/2015 | Kim | |
| 2016/0369444 | A1 | 12/2016 | Kim | |
| 2017/0183802 | A1 | 6/2017 | Yu | |

FOREIGN PATENT DOCUMENTS

| | | |
|---|---|---|
| KR | 10-2014-0029013 | 3/2014 |
| KR | 10-2015-0011215 | 1/2015 |
| KR | 10-2015-0011218 | 1/2015 |
| WO | WO 2014/030961 A1 | 2/2014 |

OTHER PUBLICATIONS

Extended European Search Report dated May 27, 2019, in corresponding European Patent Application No. 17872523.0.
Office Action dated Aug. 23, 2019, in U.S. Appl. No. 15/813,514.
Office Action dated Nov. 12, 2019, in U.S. Appl. No. 15/813,514.
Notice of Allowance dated Apr. 20, 2020, in U.S. Appl. No. 15/813,514.
U.S. Appl. No. 15/813,514, filed Nov. 15, 2017, Ju Bum Han, Samsung Electronics Co., Ltd.

* cited by examiner

WASHING MACHINE

CROSS-REFERENCE TO RELATED APPLICATION

This application is a continuation of U.S. Ser. No. 15/813,514, filed Nov. 15, 2017, and claims the benefit of Korean Patent Applications No. 10-2016-0155231, filed on Nov. 21, 2016 and No. 10-2017-0047447, filed on Apr. 12, 2017, in the Korean Intellectual Property Office, the disclosures of which are incorporated herein by reference.

BACKGROUND

1. Field

Embodiments of the present disclosure relate to a washing machine capable of limiting movements of a tub and preventing vibrations of the tub from being transferred to a cabinet.

2. Description of the Related Art

In general, a washing machine includes a cabinet forming an outer appearance of the washing machine, a tub disposed in the inside of the cabinet and storing water, and a washing drum disposed in the inside of the tub and accommodating laundry to wash the laundry by a water current generated according to rotations of a pulsator installed on the bottom of the washing drum. The washing machine performs a washing course to separate dirt from laundry, a rinsing course to rinse washed laundry, and a dehydration course to dehydrate wet laundry.

Particularly, during the dehydration course, the washing drum rotates at high speed, and may perform precession according to a distribution of laundry contained in the washing drum. Since the precession of the washing drum causes vibrations of the tub, a suspension apparatus is generally installed between the tub and the cabinet in order to prevent vibrations of the tub from being transferred to the cabinet.

However, if laundry contained in the washing drum is abnormally distributed to one side to be excessively unsymmetrical, the precession of the washing drum deviates from a normal level to cause excessive vibrations of the tub. In this case, due to a great displacement of the tub, the tub may collide with the cabinet despite cushioning of the suspension apparatus. Accordingly, in order to prevent the tub from colliding with the cabinet due to vibrations, a method of disposing the tub with a sufficient distance from the cabinet, or a method of attaching a cushion member such as sponge and the like on the inner surface of the cabinet has been used.

However, the method of widening the distance between the tub and the cabinet increases the size of the washing machine, and the method of attaching the cushion member on the inner wall of the cabinet requires a separate work process and increases the cost of materials.

SUMMARY

Therefore, it is an aspect of the present disclosure to provide a washing machine having a structure capable of limiting a movement range of a tub according to vibrations, and preventing vibrations of the tub from being transferred to a cabinet.

Additional aspects of the disclosure will be set forth in part in the description which follows and, in part, will be obvious from the description, or may be learned by practice of the disclosure.

In accordance with one aspect of the present disclosure, a washing machine includes a cabinet; a tub disposed in the inside of the cabinet; at least one suspension apparatus configured to reduce vibrations of the tub, and to connect the tub to the cabinet such that the tub is supported on the cabinet; and a position guide apparatus having one end connected to the at least one suspension apparatus, and the other end connected to the tub, and configured to limit a movement range in horizontal direction of the tub.

The position guide apparatus may include a cylinder having an inside space; and a stopper having at least one portion located in the inside space of the cylinder, and the remaining portion located outside the cylinder.

A catching portion may be formed at an end of the at least one portion of the stopper located in the inside space of the cylinder, and a suspension bar coupling portion may be formed at one end of the remaining portion of the stopper located outside the cylinder, wherein the suspension bar coupling portion may be connected to a suspension bar included in the suspension apparatus.

One end of the cylinder may further include a stopper inserting hole along which a stopper moves, and the other end of the cylinder may further include a tub fixing hole, wherein a tub fixing portion may be inserted into the tub fixing hole such that both ends of the tub fixing portion may be rotatably coupled with a position guide apparatus coupling portion formed in the outer surface of the tub.

The tub fixing portion may be inserted into the cylinder such that the cylinder may be rotatable on the tub fixing portion as a rotation shaft.

The stopper may include a first absorption member disposed adjacent to the catching portion, and a second absorption member disposed adjacent to the suspension bar coupling portion.

The cylinder may be movable between a first position at which the cylinder contacts the first absorption member, and a second position at which the cylinder contacts the second absorption member.

The suspension bar coupling portion may include a first member having a first accommodating space into which the stopper may be inserted, and a second member having a second accommodating space into which the suspension bar may be inserted.

The second member may further include a protrusion, and the first member may further include a groove into which the protrusion of the second member may be inserted so that the second member may be coupled with the first member to be rotatable with respect to the first member using the protrusion as a rotation shaft.

The second accommodating space may be movable along the suspension bar.

The stopper may include a first absorption member disposed on one surface with respect to the catching portion, and a second absorption member disposed on the opposite surface with respect to the catching portion.

The position guide apparatus may limit a distance between the suspension apparatus and the tub to a predetermined distance.

In accordance with another aspect of the present disclosure, a washing machine includes a cabinet; a tub disposed in the inside of the cabinet; a suspension bar configured to connect the tub to the cabinet such that the tub is supported on the cabinet; and a position guide apparatus including a transversely moving portion connected to the tub, a longitudinally moving portion connected to the suspension bar, and a friction member disposed in the inside of the longitudinally moving portion in such a way to surround the suspension bar, wherein the position guide apparatus is limited in moving by the friction member when the longitudinally moving portion moves along the suspension bar.

A pair of arms may be formed at one end of the transversely moving portion, a pair of protrusions may be formed on an outer surface of the longitudinally moving portion, and the pair of protrusions may be inserted into openings respectively formed in the pair of arms so that the transversely moving portion may be coupled with the longitudinally moving portion.

If the position guide apparatus may be coupled with the tub and the suspension bar, and the protrusions formed on the outer surface of the longitudinally moving portion may be inserted into and coupled with the openings formed in the arms of the transversely moving portion, the transversely moving portion may be coupled with the longitudinally moving portion such that the transversely moving portion and the longitudinally moving portion may form an obtuse angle.

The longitudinally moving portion may further include a friction member inserting space therein, and the friction member may be disposed in at least one area of the friction member inserting space.

The friction member may be movable in the friction member inserting space.

The openings formed in the arms of the transversely moving portion extend in a direction toward the pair of arms from a center of the transversely moving portion, and may include a first absorption member disposed in one ends of inner surfaces of the openings, and a second absorption member disposed in the other ends of the inner surfaces of the openings.

A catching groove included in a first member having a hole to pass the suspension bar through may be coupled with a protrusion included in a second member having a hole to pass the suspension bar through, thereby forming the longitudinally moving portion.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
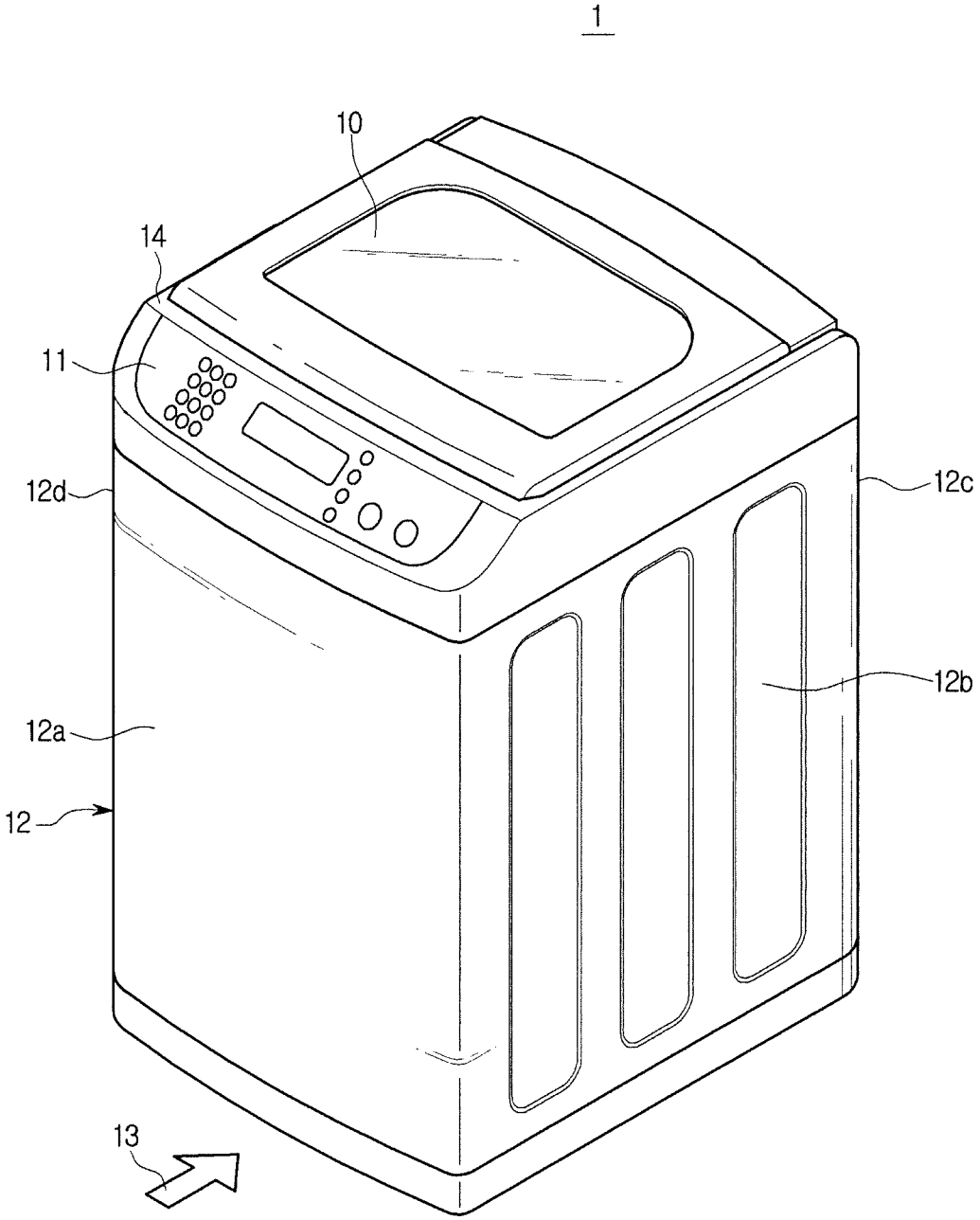
FIG. 1 is a perspective view of a washing machine according to an embodiment of the present disclosure.

Hereinafter, various embodiments of the present disclosure will be described with reference to the accompanying drawings. The embodiments and terms used in the embodiments are not for the purpose of limiting technology disclosed in the present disclosure to specific embodiments, and it should be understood that all modifications, equivalents, and substitutes can be made on the embodiments. In regard of descriptions of the drawings, similar components will be referred to as similar reference numerals. Also, it is to be understood that the singular forms "a," "an," and "the" include plural referents unless the context clearly dictates otherwise. In the present disclosure, the term 'A or B' or 'at least one of A or/and B' may cover all possible combinations of enumerated items. The expressions 'first' or 'second' may modify the names of various components irrespective of sequence and/or importance, not limiting the components. These expressions may be used to distinguish one component from another component. For example, when it is said that a component (e.g., a first component) is 'operatively or communicatively coupled with/to' or 'connected to' another component (e.g., a second component), it should be understood that the one component is connected to the other component directly or through any other component (e.g., a third component).

The term 'configured to' as used herein may be replaced with, for example, the term 'suitable for' 'having the capacity to', 'designed to', 'adapted to', 'made to', or 'capable of' under circumstances. The term 'configured to' may not necessarily mean 'specifically designed to' in hardware. Instead, the term 'configured to' may mean that a device may mean 'capable of' with another device or part. For example, 'a processor configured to execute A, B, and C' may mean a dedicated processor (e.g., an embedded processor) for performing the corresponding operations or a generic-purpose processor (e.g., a central processing unit (CPU) or an application processor (AP)) for performing the corresponding operations.

FIG. 1 is a perspective view of a washing machine according to an embodiment of the present disclosure.

Referring to FIG. 1, a cabinet 12 forming an outer appearance of a washing machine 1 may be in the shape of a nearly rectangular parallelepiped having an open top portion and an open bottom portion, and may include left and right side panels 12*b* and 12*d*, a front panel 12*a*, and a rear panel 12*c*. The upper portion of the cabinet 12 may be coupled with a top cover 14 having an opening to enable a user to put laundry into a washing drum (not shown), and a door 10 for opening or closing the opening may be coupled with the top cover 14. Also, a control panel 11 for enabling the user to input operation and control settings of the washing machine 1 may be mounted on one side of the top cover 14. In the following description, for convenience of description, a portion indicated by an arrow direction of FIG. 1 is assumed to be a front portion of the cabinet 12.

Figure 2:
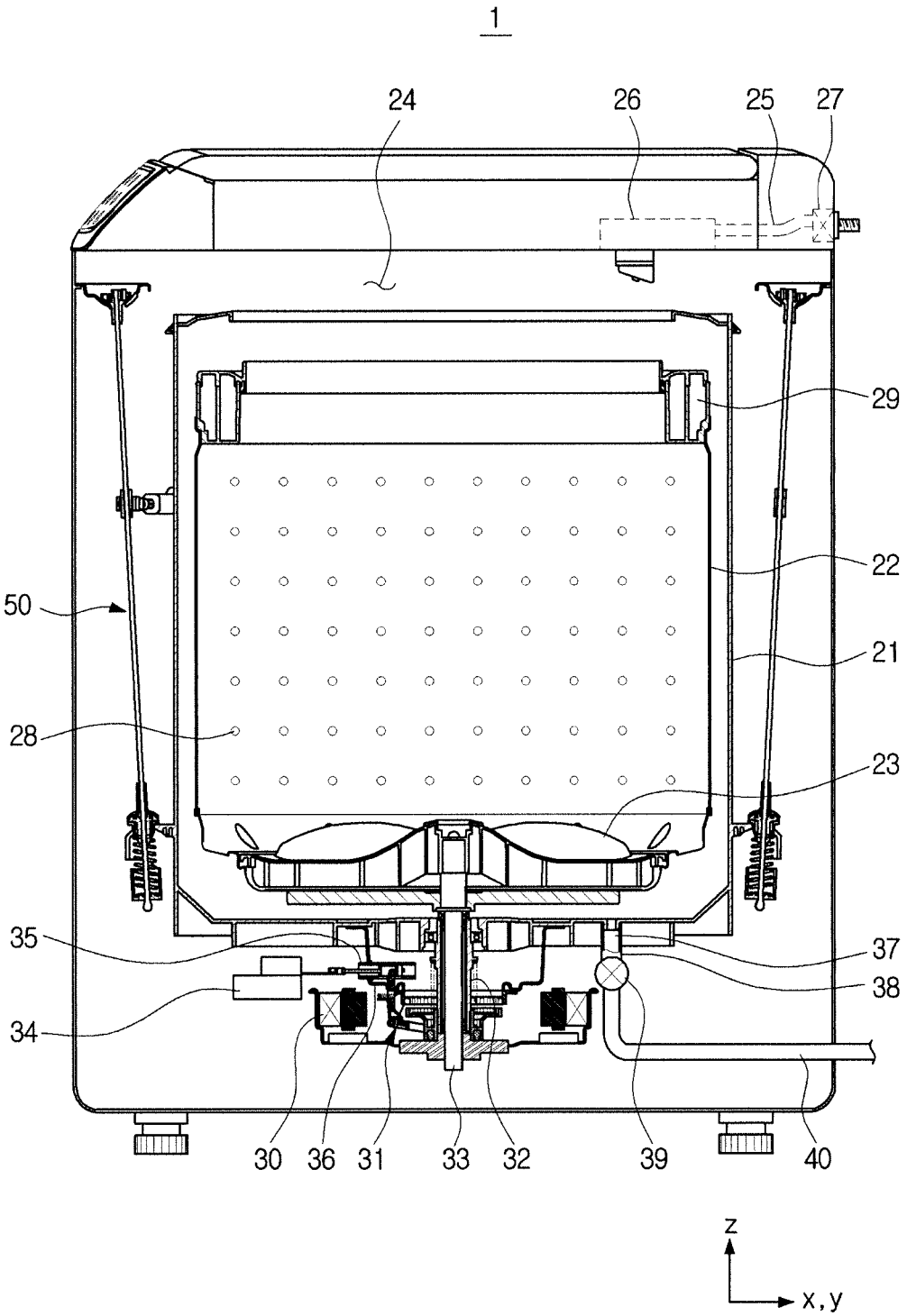
FIG. 2 is a cross-sectional view of the washing machine according to the embodiment of the present disclosure.

FIG. 2 is a cross-sectional view of the washing machine according to the embodiment of the present disclosure.

Referring to FIG. 2, in the inside of the cabinet 12 forming the outer appearance of the washing machine 1, a tub 21 in which washing water is stored, a washing drum 22 rotatably disposed in the inside of the tub 21, and a pulsator 23 disposed in the inside of the washing drum 22 to generate a water current may be installed.

In the upper portion of the cabinet 12, an opening 24 may be formed to enable a user to put laundry into the washing drum 22. The opening 24 may be opened or closed by the door 10 mounted on the upper portion of the cabinet 12. The tub 21 may be supported on the cabinet 12 by a suspension apparatus 50.

In the upper portion of the tub 21, a water-supply pipe 25 may be installed to supply washing water into the tub 21. One end of the water-supply pipe 25 may be connected to an external water-supply source, and the other end of the water-supply pipe 25 may be connected to a detergent supply apparatus 26. Water supplied through the water-supply pipe 25 may be supplied into the tub 21 together with a detergent via the detergent supply apparatus 26. The water-supply pipe 25 may include a water-supply valve 27 to control supply of water.

The washing drum 22 may be in the shape of a cylinder whose top portion opens, and a plurality of dehydrating holes may be formed in the side of the washing drum 22. On the top of the washing drum 22, a balancer 29 may be disposed so that the washing drum 22 can stably rotate upon high-speed rotation.

Below the tub 21, a motor 30 to generate a driving force for rotating the washing drum 22 and the pulsator 23, and a power transfer apparatus 31 to transfer the driving force generated by the motor 30 to both or one of the washing drum 22 and the pulsator 23 may be disposed.

The washing drum 22 may be connected to a hollow dehydrating shaft 32, and a washing shaft 33 installed in the cavity of the dehydrating shaft 32 may be connected to the pulsator 23 through a washing shaft connecting element (not shown). The motor 30 may transfer a driving force to all or one of the washing drum 22 and the pulsator 23 according to elevating operation of the power transfer apparatus 31.

The power transfer apparatus 31 may include an actuator 34 to generate a driving force for transferring power, a rod portion 35 to move linearly according to operation of the actuator 34, and a clutch portion 36 connected to the rod portion 35 to rotate according to operation of the rod portion 35.

In a bottom of the tub 21, a drain outlet 37 may be formed to discharge washing water stored in the tub 21, and the drain outlet 37 may be connected to a first drain pipe 38. In the first drain pipe 38, a drain valve 39 for controlling drainage may be installed. An outlet of the drain valve 39 may be connected to a second drain pipe 40 for discharging washing water to the outside.

Figure 3:
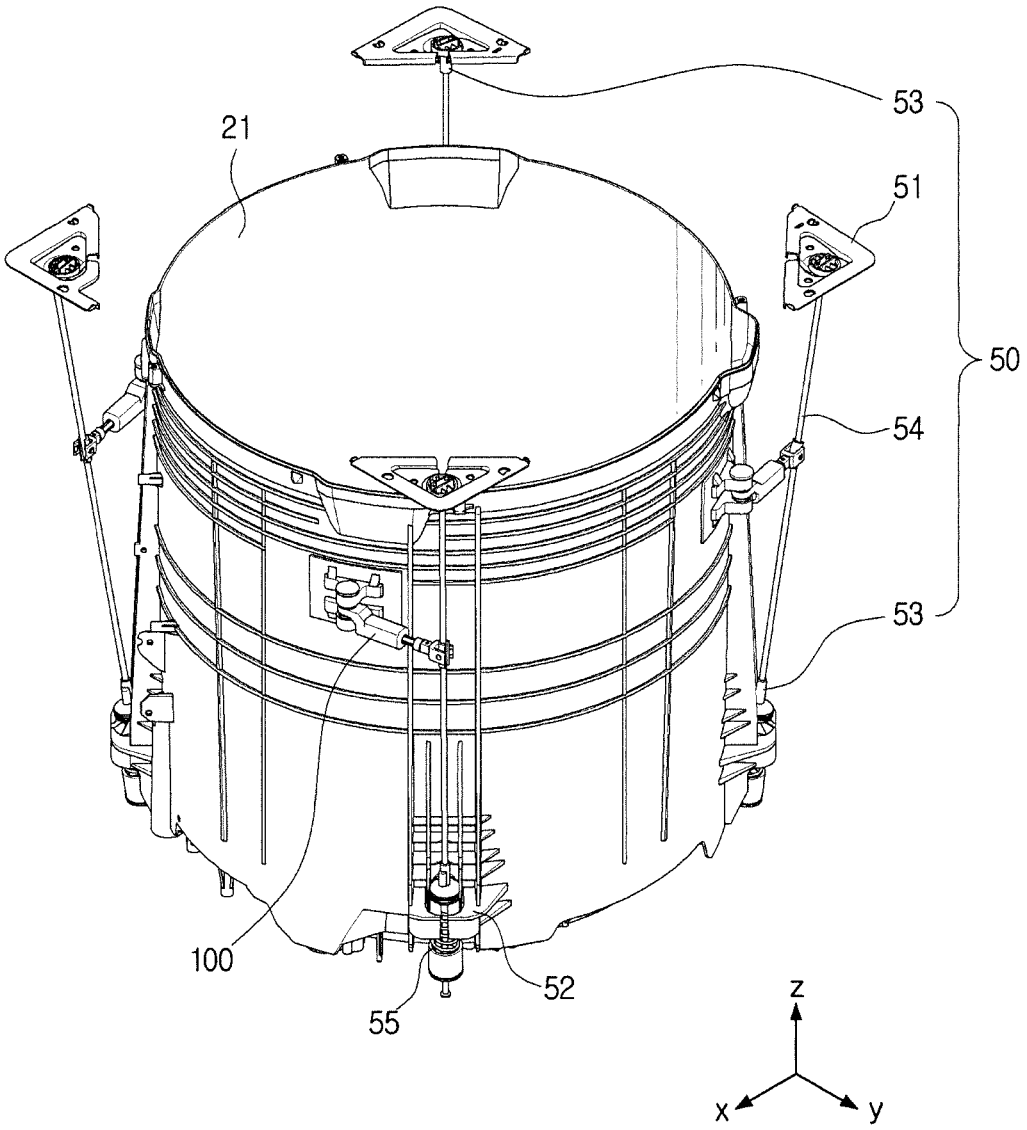
FIG. 3 is a perspective view showing a tub, a suspension apparatus, and a position guide apparatus of the washing machine according to the embodiment of the present disclosure.
Figure 4:
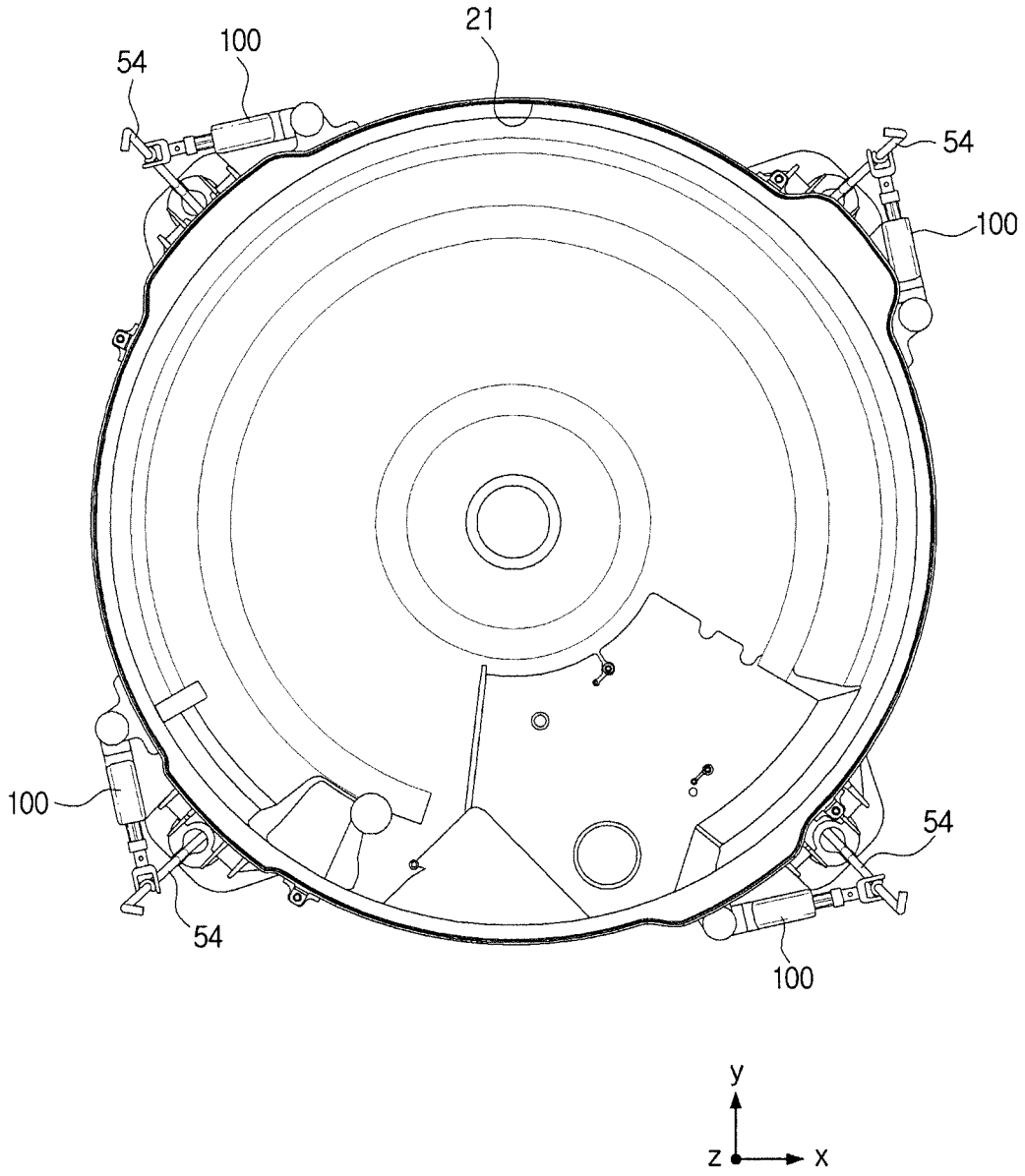
FIG. 4 is a top view showing the tub, the suspension apparatus, and the position guide apparatus of the washing machine according to the embodiment of the present disclosure.

FIG. 3 is a perspective view showing a tub, a suspension apparatus, and a position guide apparatus of the washing machine according to the embodiment of the present disclosure, and FIG. 4 is a top view showing the tub, the suspension apparatus, and the position guide apparatus of the washing machine according to the embodiment of the present disclosure.

Referring to FIGS. 3 and 4, the suspension apparatus 50 may be disposed in the inside of the cabinet (for example, the cabinet 12 of FIG. 1) in order to reduce vibrations of the tub 21. More specifically, the suspension apparatus 50 may be coupled with a first holder 51 disposed on an inner upper surface of the cabinet 12 and a second holder 52 disposed on an outer lower surface of the tub 21 to cushion vibrations and impacts transferred from the tub 21. The first holder 51 and the second holder 52 may be disposed at different positions.

The suspension apparatus 50 may include a suspension cap 53, a suspension bar 54, and a spring 55, although not limited to these. The suspension apparatus 50 may add other components or omit some components in order to improve an effect of cushioning vibrations or impacts transferred from the tub 21.

The spring 55 may be disposed in a lower portion of the suspension bar 54, and contracted or relaxed by vibrations and impacts transferred from the tub 21, thereby cushioning and reducing the vibrations and impacts.

The suspension apparatus 50 may function to reduce all of vibrations generated in a vertical direction (Z-axis) and vibrations generated in a horizontal direction (XY plane)

according to an installation angle. Since vector components in the vertical direction are generally greater than in the horizontal direction, the suspension apparatus 50 may have an effect of mainly reducing vibrations generated in the vertical direction.

One end of the position guide apparatus 100 may be installed on the tub 21, and the other end of the position guide apparatus 100 may be connected to an area of the suspension bar 54.

Since the position guide apparatus 100 limits movements in horizontal direction of the tub 21, the suspension apparatus 50 may be installed nearly vertically to increase the capacity of the tub 21 in the inside of the cabinet 12. Thereby, a range of movement on the XY plane can be reduced even when the tub 21 becomes close to the cabinet 12, so that the position guide apparatus 100 can prevent the tub 21 from contacting the cabinet 12 or prevent the generation of noise.

Figure 5:
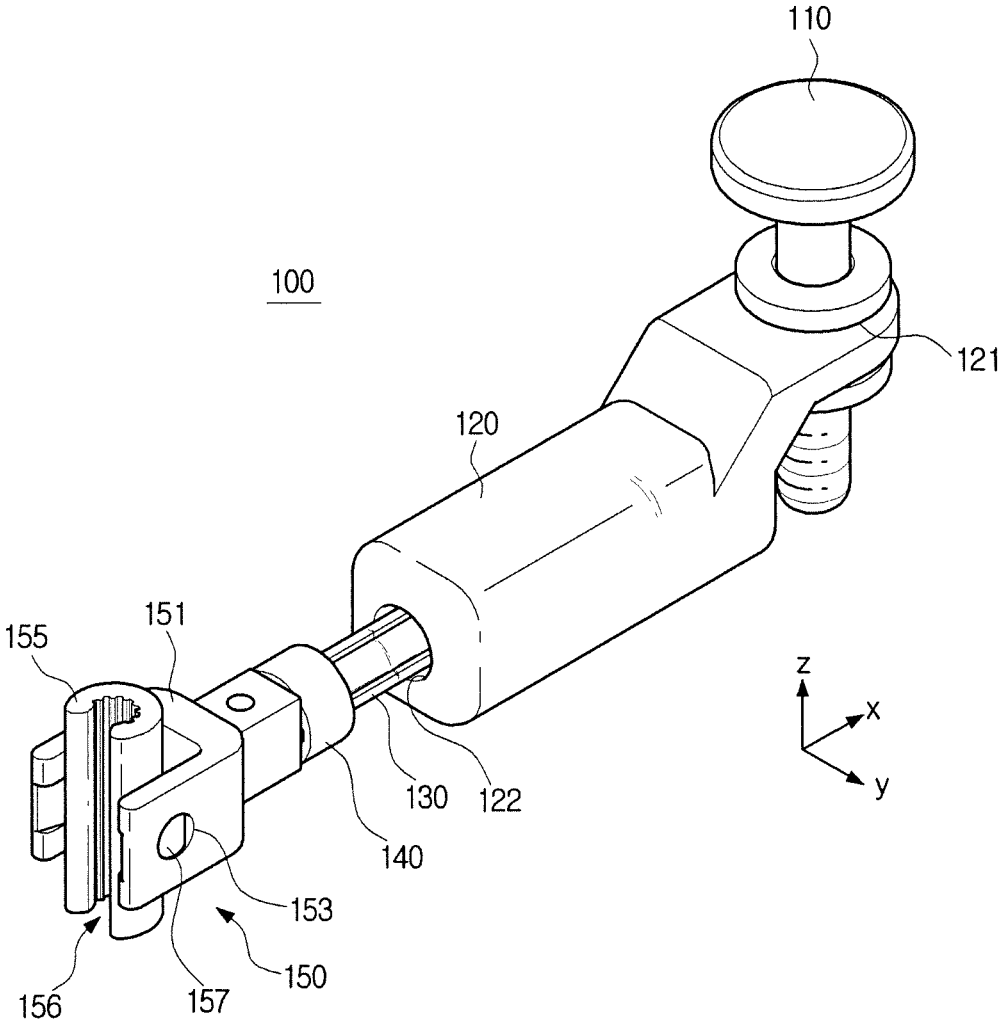
FIG. 5 shows the position guide apparatus of the washing machine according to the embodiment of the present disclosure.
Figure 6:
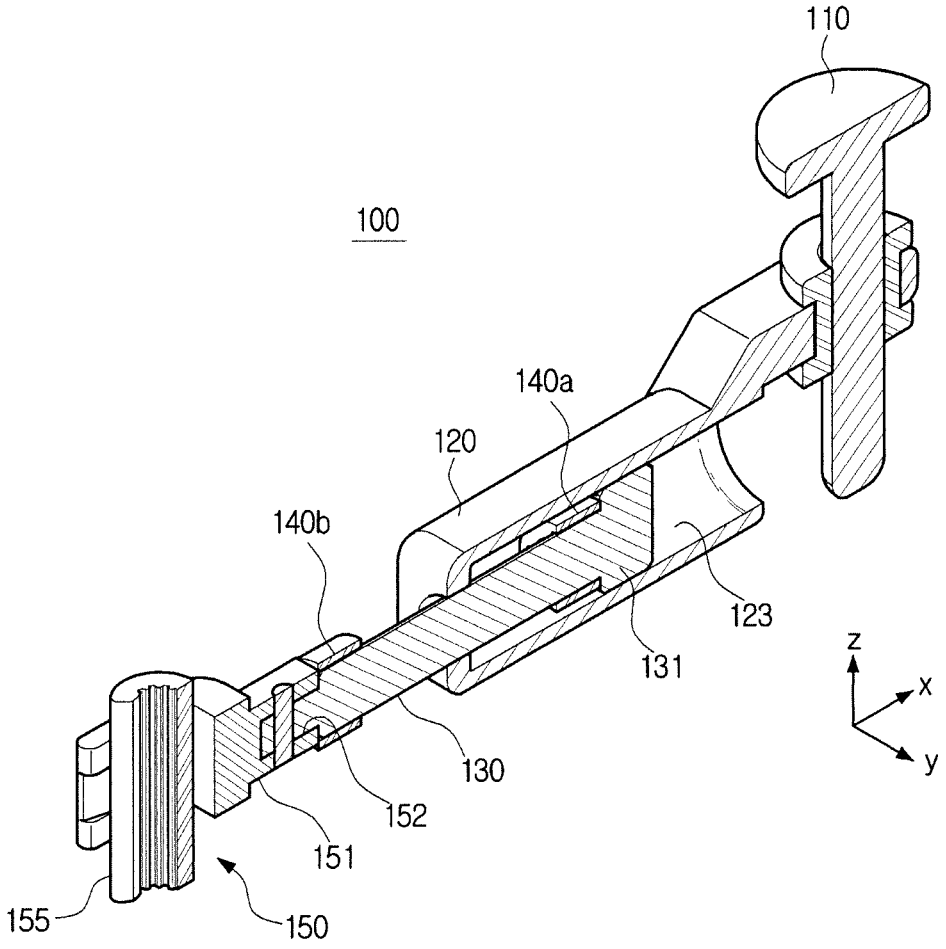
FIG. 6 is a cross-sectional view of the position guide apparatus of the washing machine according to the embodiment of the present disclosure.

FIG. 5 shows the position guide apparatus of the washing machine according to the embodiment of the present disclosure, and FIG. 6 is a cross-sectional view of the position guide apparatus of the washing machine according to the embodiment of the present disclosure.

Referring to FIGS. 5 and 6, the position guide apparatus 100 may include a tub fixing portion 110, a cylinder 120, an absorption member 140, and a suspension bar coupling portion 150.

The tub fixing portion 110 may connect the cylinder 120 of the position guide apparatus 100 to the tub 21. In the state in which one end of the tub fixing portion 110 is coupled with a position guide apparatus coupling portion (not shown) formed in the outer surface of the tub 21, the tub fixing portion 110 may be inserted in a tub fixing portion inserting hole 121 formed in one end of the cylinder 120. If the tub fixing portion 110 is inserted in the cylinder 120, the cylinder 120 can rotate on the tub fixing portion 110 as a rotation shaft.

In one end of the cylinder 120, the tub fixing portion inserting hole 121 into which the tub fixing portion 110 can be inserted may be formed, and in the other end of the cylinder 120, a stopper inserting hole 122 into which a stopper 130 can be inserted may be formed. The tub fixing portion inserting hole 121 may be formed along the Z axis, and the stopper inserting hole 122 may be formed on the XY plane that is vertical to the Z axis. However, the positions of the tub fixing portion inserting hole 121 and the stopper inserting hole 122 are not limited to these, and the tub fixing portion inserting hole 121 and the stopper inserting hole 122 may be formed at any other positions. The cylinder 120 may have a space 123 in which at least one portion of the stopper 130 can be located. The space 123 in which at least one portion of the stopper 130 can be located may extend along an X-axis.

At least one portion of the stopper 130 may be located in the inside of the cylinder 120, and the remaining portion of the stopper 130 may be located outside the cylinder 120. The stopper 130 may move linearly along the inside space 123 of the cylinder 120.

In an end of the portion of the stopper 120 located in the inside of the cylinder 120, a catching portion 131 may be formed. The catching portion 131 may prevent the stopper 120 from getting out of the cylinder 120, when the stopper 130 moves back and forth in the inside space 120 of the cylinder 120.

An end of the remaining portion of the stopper 120 located outside the cylinder 120 may be connected to the suspension bar coupling portion 150. The suspension bar coupling portion 150 may include a first member 151 having a first accommodating space 152 into which the stopper 130 can be inserted, and a second member 155 having a second accommodating space 156 into which the suspension bar 54 can be inserted.

The end of the stopper 130 located outside the cylinder 120 may be inserted in the first accommodating space 152 of the first member 151 of the suspension bar coupling portion 150. The first member 151 may include a hole 153 into which the second member 155 can be inserted. A protrusion 157 of the second member 155 may be coupled with the hole 153 of the first member 151. In this case, the second member 155 may rotate on the protrusion 157. The second member 155 may form the second accommodating space 156. The suspension bar 54 may be inserted into the second accommodating space 156. In the state in which the suspension bar 54 is inserted in the second accommodating space 156, the suspension bar 54 may move along the Z-axis direction.

The stopper 130 may include a first absorption member 140*a* and a second absorption member 140*b*. The first absorption member 140*a* may be disposed adjacent to the catching portion 131, and the second absorption member 140*b* may be disposed adjacent to the suspension bar coupling portion 150. The absorption member 140 may be made of, for example, rubber or silicon. The absorption member 140 may reduce noise that is generated when the cylinder 120 moves linearly to contact the catching portion 131 located at one end of the stopper 130 or the suspension bar coupling portion 150 located at the other end of the stopper 130.

A situation in which the first absorption member 140*a* contacts the inner wall of the cylinder 120 may be a case in which the portion of the stopper 130 located inside the cylinder 120 is drawn outside the cylinder 120 so that the position guide apparatus control apparatus 100 lengthens. A situation in which the second absorption member 140*b* contacts the outer wall of the cylinder 120 may be a case in which the other portion of the stopper 130 located outside the cylinder 120 is pushed into the inside of the cylinder 120 so that the position guide apparatus 100 shortens. The cylinder 120 may move between a first position at which the position guide apparatus 100 lengthens and a second position at which the position guide apparatus 100 shortens.

According to an embodiment, a length to which the cylinder 120 can move according to a movement of the tub 21 may be decided according to the inside space 123 of the cylinder 120 and a distance between the absorption members 140*a* and 140*b* disposed at both ends of the stopper 130.

FIGS. 7A, 7B, 8A, and 8B are views for describing a situation in which the position guide apparatus lengthens according to a movement of the tub generated in the washing machine according to the embodiment of the present disclosure.

According to an embodiment, the tub 21 may include at least one position guide apparatus 100 on the outer surface.

Figure 7A:
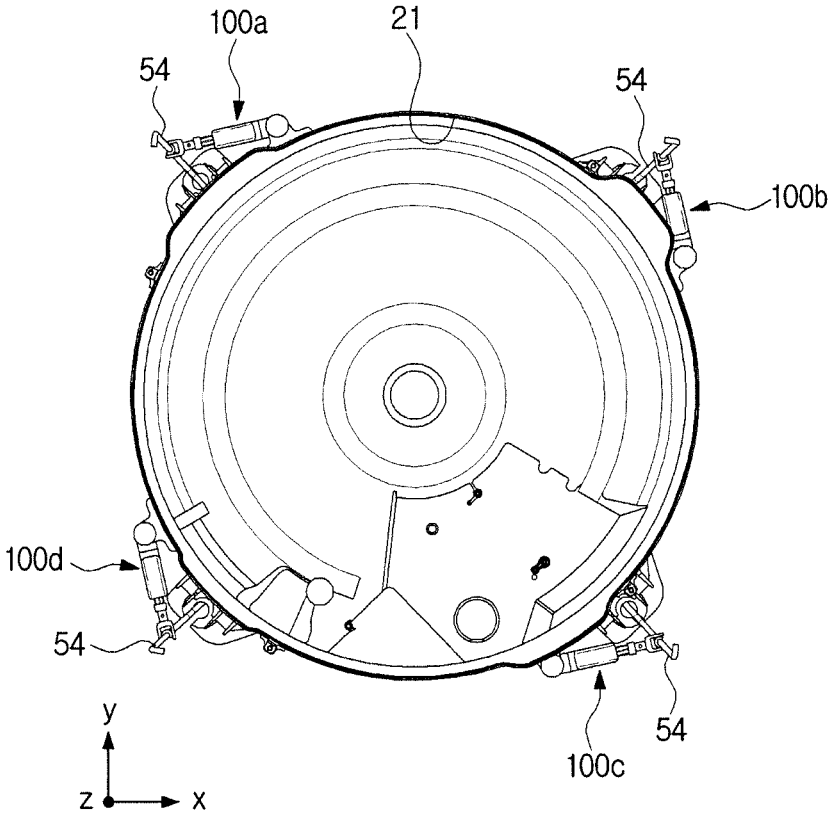
FIGS. 7A, 7B, 8A, and 8B are views for describing a situation in which the position guide apparatus lengthens according to a movement of the tub generated in the washing machine according to the embodiment of the present disclosure.

Referring to FIG. 7A, the washing machine (for example, the washing machine 1 of FIG. 1) may include four position guide apparatuses 100*a*, 100*b*, 100*c*, and 100*d*. The four position guide apparatuses 100*a*, 100*b*, 100*c*, and 100*d* may be installed at intervals of about 90 degrees on the outer surface of the tub 21. As described above with reference to FIGS. 5 and 6, one end of each position guide apparatus 100 may be coupled with the tub 21 in such a way to be rotatable on the Z-axis, and the other end of the position guide apparatus 100 may be coupled with the suspension bar 54 in such a way to be movable along the suspension bar 54.

According to an embodiment, in order to efficiently correct a position, the position guide apparatus 100 may be positioned in a direction that is similar to a tangential direction on the outer side surface of the tub 21.

In this state, if the washing drum (for example, the washing drum 22 of FIG. 2) starts rotating, the tub 21 may move in left and right directions (on the XY plane), or roll on the Z-axis.

More specifically, if the washing machine 1 starts a dehydration course, the washing machine 1 may rotate the washing drum 22. The washing machine 1 may increase revolution per minute (RPM) of the washing drum 22 gradually. For example, the washing machine 1 may increase the RPM of the washing drum 22 from 0 rpm to 800 rpm. However, the RPM of the washing drum 22 is not limited to these, and the RPM of the washing drum 22 may be greater or smaller than 800 rpm according to the type of the washing machine 1. A section for which the washing machine 1 gradually increases the RPM of the washing drum 22 may be defined as a transient section.

According to an embodiment, if the washing drum 22 rotates, the tub 21 may perform six motions. The six motions may include motions in the X-axis, Y-axis, and Z-axis directions and rotational motions on the X-axis, Y-axis, and Z-axis.

If the RPM of the washing drum 22 reaches about 100 rpm, the tub 21 may perform left-right motions moving in the left and right directions on the XY plane. Also, if the RPM of the washing drum 22 reaches about 250 rpm, the tub 21 may perform rolling on the Z-axis. However, the motions of the tub 21 generated according to the rotation of the washing drum 22 are not limited to these, and the tub 21 may perform various motions during the transient section.

Figure 7B:
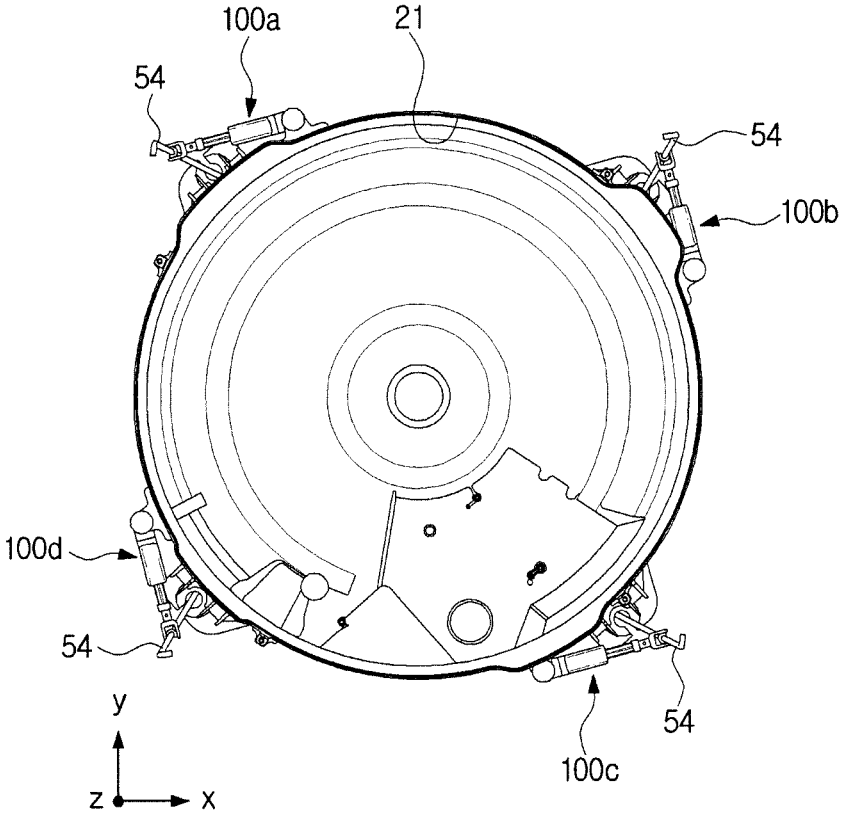

Referring to FIG. 7B, the tub 21 may move in a positive (+) X-axis direction. In this case, the position guide apparatuses 100*a*, 100*b*, 100*c*, and 100*d* may lengthen or shorten according to their positions.

For example, if the tub 21 moves in the positive (+) X-axis direction, the first position guide apparatus 100*a* may lengthen, and the third position guide apparatus 100*c* may shorten. Also, the second position guide apparatus 100*b* and the fourth position guide apparatus 100*d* may be maintained at their positions similarly to the state shown in FIG. 7A. However, lengths to which the position guide apparatuses 100*a* and 100*c* lengthen and shorten may vary according to the moving direction of the tub 21.

Figure 8A:
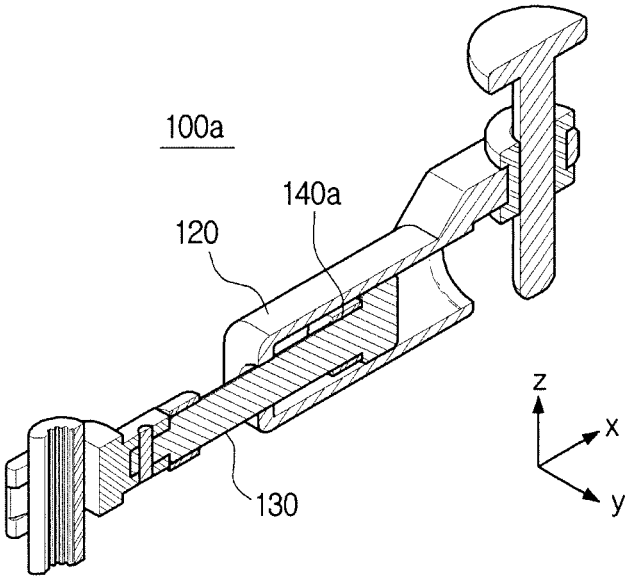

Referring to FIG. 8A, the position guide apparatus 100*a* may lengthen according to a movement of the tub 21. That is, if the cylinder 120 moves in the positive (+) X-axis direction, a portion of the stopper 130 located in the inside of the cylinder 120 may be drawn to the outside of the cylinder 120.

Figure 8B:
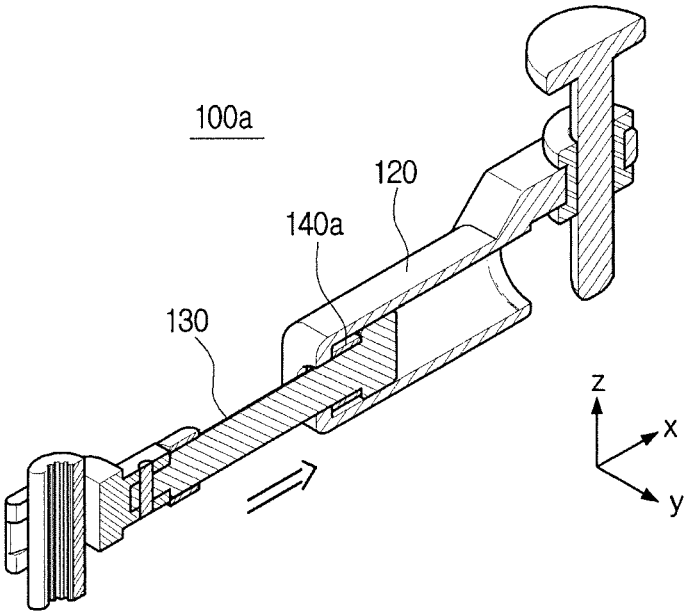

Referring to FIG. 8B, if the cylinder 120 further moves in the positive (+) X-axis direction, the first absorption member 140*a* may contact the inner side surface of the cylinder 120. Accordingly, the cylinder 120 cannot move any longer. The first absorption member 140*a* may reduce noise due to an impact that is generated when the stopper 130 contacts the inner side surface of the cylinder 120.

If the first absorption member 140*a* contacts the inner side surface of the cylinder 120, the tub 21 cannot move in the positive (+) X-axis direction any longer. As such, the movement of the tub 21 on the XY plane may be limited by the position guide apparatus 100.

FIGS. 9A, 9B, 10A, and 10B are views for describing a situation in which the position guide apparatus shortens according to a movement of the tub generated in the washing machine according to the embodiment of the present disclosure.

Figure 9A:
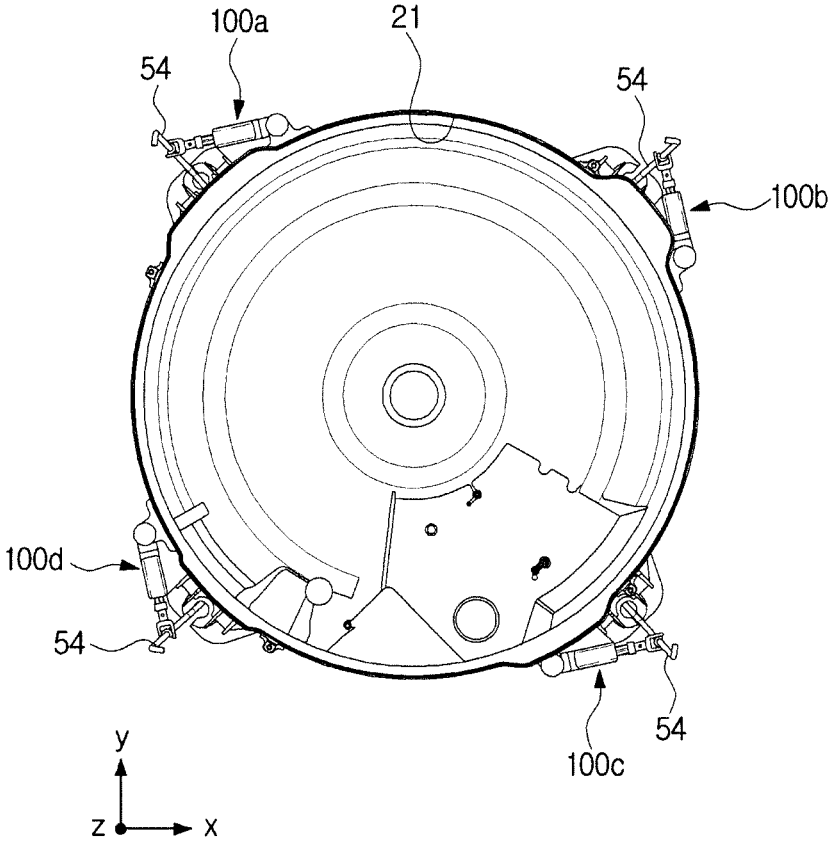
FIGS. 9A, 9B, 10A, and 10B are views for describing a situation in which the position guide apparatus shortens according to a movement of the tub generated in the washing machine according to the embodiment of the present disclosure.

Referring to FIG. 9A, the washing machine (for example, the washing machine 1 of FIG. 1) may include four position guide apparatuses 100*a*, 100*b*, 100*c*, and 100*d*. The four position guide apparatuses 100*a*, 100*b*, 100*c*, and 100*d* may be installed at intervals of about 90 degrees on the outer surface of the tub 21. One end of each position guide apparatus 100 may be coupled with the tub 21 in such a way to be rotatable on the Z-axis, and the other end of the position guide apparatus 100 may be coupled with the suspension bar 54 in such a way to be movable along the suspension bar 54.

In this state, if the washing drum (for example, the washing drum 22 of FIG. 2) starts rotating, the tub 21 may move in left and right directions (on the XY plane), or roll on the Z-axis.

More specifically, if the washing machine (for example, the washing machine 1 of FIG. 1) starts a dehydration course, the washing machine 1 may rotate the washing drum 22. If the washing drum 22 rotates, the tub 21 may perform six motions. The six motions may include motions in the X-axis, Y-axis, and Z-axis directions and rotational motions on the X-axis, Y-axis, and Z-axis.

If the RPM of the washing drum 22 reaches about 100 rpm, the tub 21 may perform left-right motions moving in the left and right directions on the XY plane. Also, if the RPM of the washing drum 22 reaches about 250 rpm, the tub 21 may roll on the Z-axis.

Figure 9B:
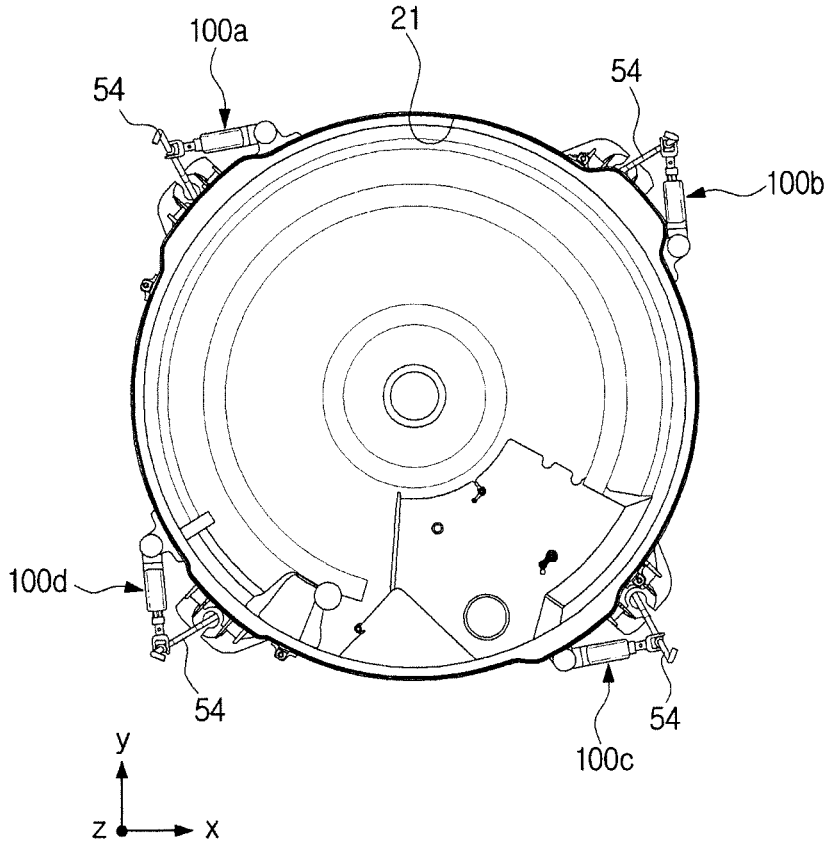

Referring to FIG. 9B, the tub 21 may move in a negative (−) X-axis direction. In this case, the position guide apparatuses 100*a* to 100*d* may lengthen or shorten according to their positions.

For example, if the tub 21 moves in the negative (−) X-axis direction, the first position guide apparatus 100*a* may shorten, and the third position guide apparatus 100*c* may lengthen. Also, the second position guide apparatus 100*b* and the fourth position guide apparatus 100*d* may be maintained at their positions similarly to the state shown in FIG. 9A. That is, the position guide apparatuses 100*a* and 100*c* may lengthen or shorten according to the moving direction of the tub 21.

Figure 10A:
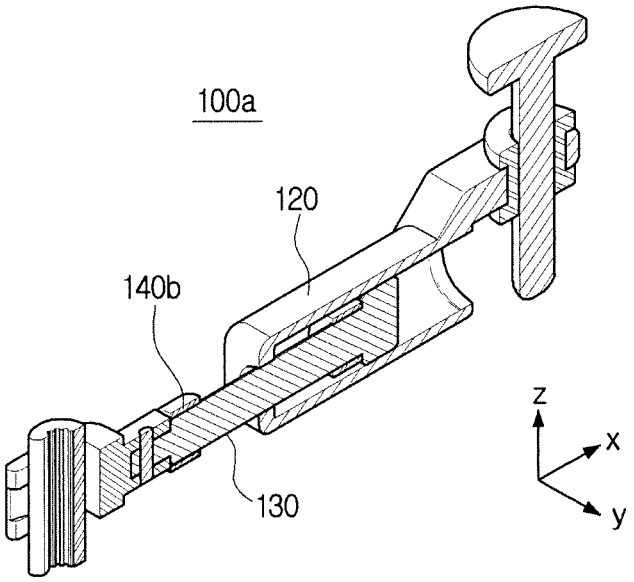

Referring to FIG. 10A, the position guide apparatus 100*a* may shorten according to a movement of the tub 21. That is, if the cylinder 120 moves in the negative (−) X-axis direction, a portion of the stopper 130 located outside the cylinder 120 may be pushed into the inside of the cylinder 120.

Figure 10B:
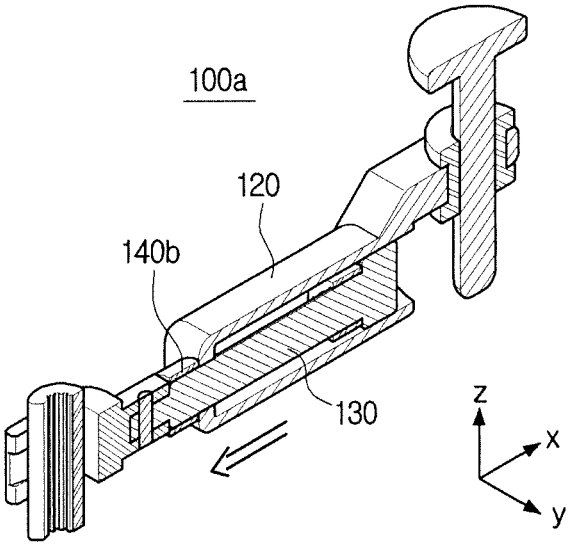

Referring to FIG. 10B, if the cylinder 120 further moves in the negative (−) X-axis direction, the second absorption member 140*b* may contact the outer side surface of the cylinder 120. Accordingly, the cylinder 120 cannot move any longer. The second absorption member 140*b* can reduce noise due to an impact that is generated when the stopper 130 contacts the outer side surface of the cylinder 120.

If the second absorption member 140*b* contacts the outer side surface of the cylinder 120, the tub 21 cannot move in the negative (−) X-axis direction any longer. In this way, the movement of the tub 21 on the XY plane may be limited by the position guide apparatus 100.

So far, movements in X-axis direction of the tub 21 have been described. Also, movements in Y-axis direction of the tub 21 may be limited by the position guide apparatus 100 to be reduced.

Figure 11:
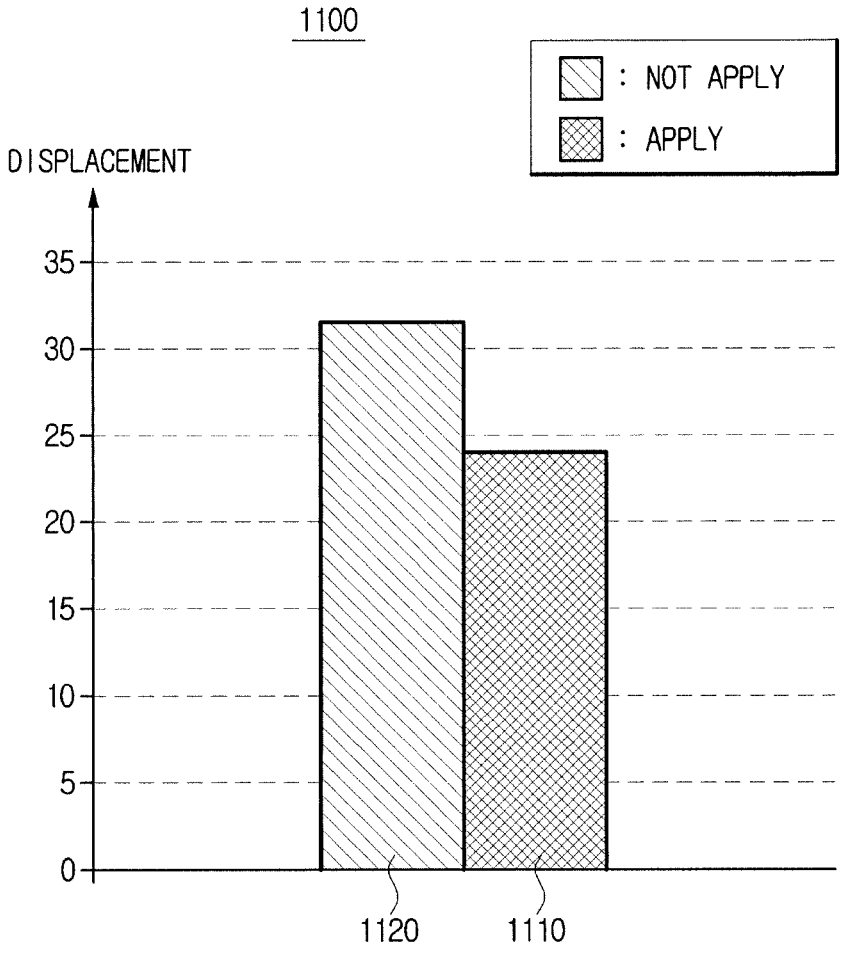
FIG. 11 is a graph for comparing a case in which the washing machine according to the embodiment includes the position guide apparatus to a case in which the washing machine includes no position guide apparatus.

FIG. 11 is a graph for comparing a case in which the washing machine according to the embodiment includes the position guide apparatus to a case in which the washing machine includes no position guide apparatus.

Referring to FIG. 11, in a graph 1100, the X-axis represents a case 1110 in which the position guide apparatus is installed and a case 1120 in which no position guide apparatus is installed, and the Y-axis represents displacements of the tub (for example, the tub 21 of FIG. 2). The graph 1100 shows results of measurement through an experiment of increasing the RPM of the washing drum 22 from 0 rpm to 800 rpm after installing a weight of 1.0 kg inside the washing drum 22.

According to an embodiment, in the case 1120 in which no position guide apparatus is installed, the tub 21 may move to a distance of 31.80 mm in the left and right directions. In the case 1110 in which the position guide apparatus is installed, the tub 21 may move to a distance of 24.06 mm in the left and right directions. Compared to the case 1120 in which no position guide apparatus is installed, the movement distance of the tub 21 may be shortened by 7.74 mm in the left and right directions, resulting in a reduction rate of movement of 24.3%.

As such, the movement of the tub 21 according to the rotation of the washing machine 22 can be reduced by the position guide apparatus 100 described above.

Figure 12A:
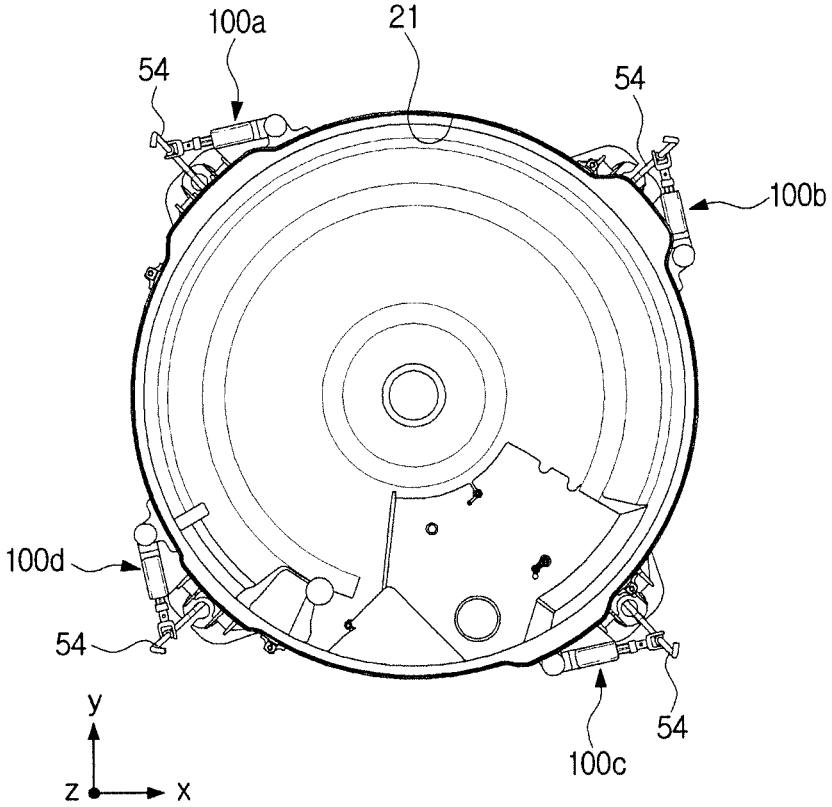
FIGS. 12A and 12B are views for describing a situation in which the position guide apparatus prevents vibrations of the tub from being transferred to the cabinet in the washing machine according to the embodiment of the present disclosure.
Figure 12B:
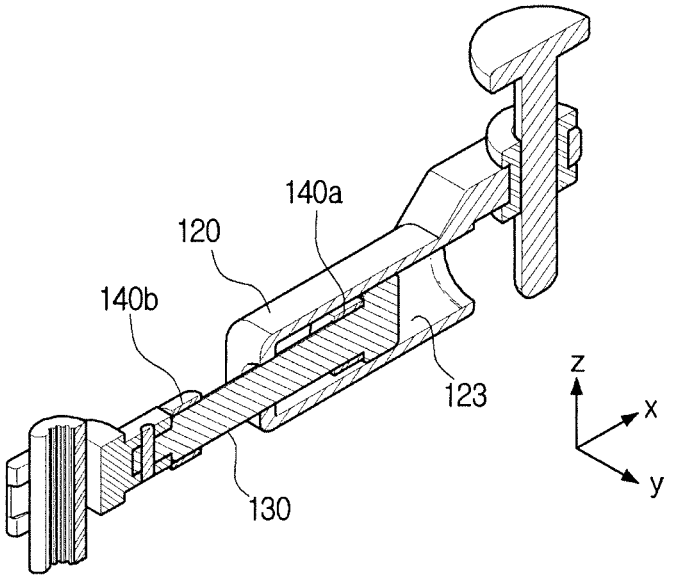

FIGS. 12A and 12B are views for describing a situation in which the position guide apparatus prevents vibrations of the tub from being transferred to the cabinet in the washing machine according to the embodiment of the present disclosure.

Referring to FIG. 12A, the washing machine (for example, the washing machine 1 of FIG. 1) may include four position guide apparatuses 100*a*, 100*b*, 100*c*, and 100*d*. The four position guide apparatuses 100*a*, 100*b*, 100*c*, and 100*d* may be installed at intervals of about 90 degrees on the outer surface of the tub 21. As described above with reference to FIGS. 5 and 6, one end of each position guide apparatus 100 may be coupled with the tub 21 in such a way to be rotatable on the Z-axis, and the other end of the position guide apparatus 100 may be coupled with the suspension bar 54 in such a way to be movable along the suspension bar 54.

As described above with reference to FIGS. 7A to 10B, if the washing drum (for example, the washing drum 22 of FIG. 2) starts rotating in this state, the tub 21 may move in the left and right directions, or roll on the Z-axis.

Also, according to an embodiment, if the RPM of the washing drum 22 is maintained at 800 rpm, the movement of the tub 21 may be reduced. A section for which the washing drum 22 is maintained at constant RPM after a transient section elapses may be defined as, for example, a steady section. During the steady section, a phenomenon in which the tub 21 moves in the left and right directions may be reduced, however, vibrations generated from the tub 21 may be transferred to the cabinet (for example, the cabinet 12 of FIG. 1) so that the cabinet 12 may vibrate.

The position guide apparatus 100 may move the stopper 130 located in the inside of the cylinder 120 to prevent vibrations generated from the tub 21 from being transferred to the cabinet 12.

Referring to FIG. 12B, if the stopper 130 moves linearly in the inside of the cylinder 120 according to a movement of the cylinder 120, no member for adding a friction force for limiting the movement of the stopper 130 may exist in the inside space 123 of the cylinder 120. Accordingly, during the steady section, the cylinder 120 may move along the X-axis without contacting either the first absorption member 140*a* or the second absorption member 140*b* so as not to transfer vibrations generated from the tub 21 to the suspension bar 54. Accordingly, the position guide apparatus 100 may not transfer vibrations generated from the tub 21 to the cabinet 12 connected to the suspension bar 54.

Figure 13:
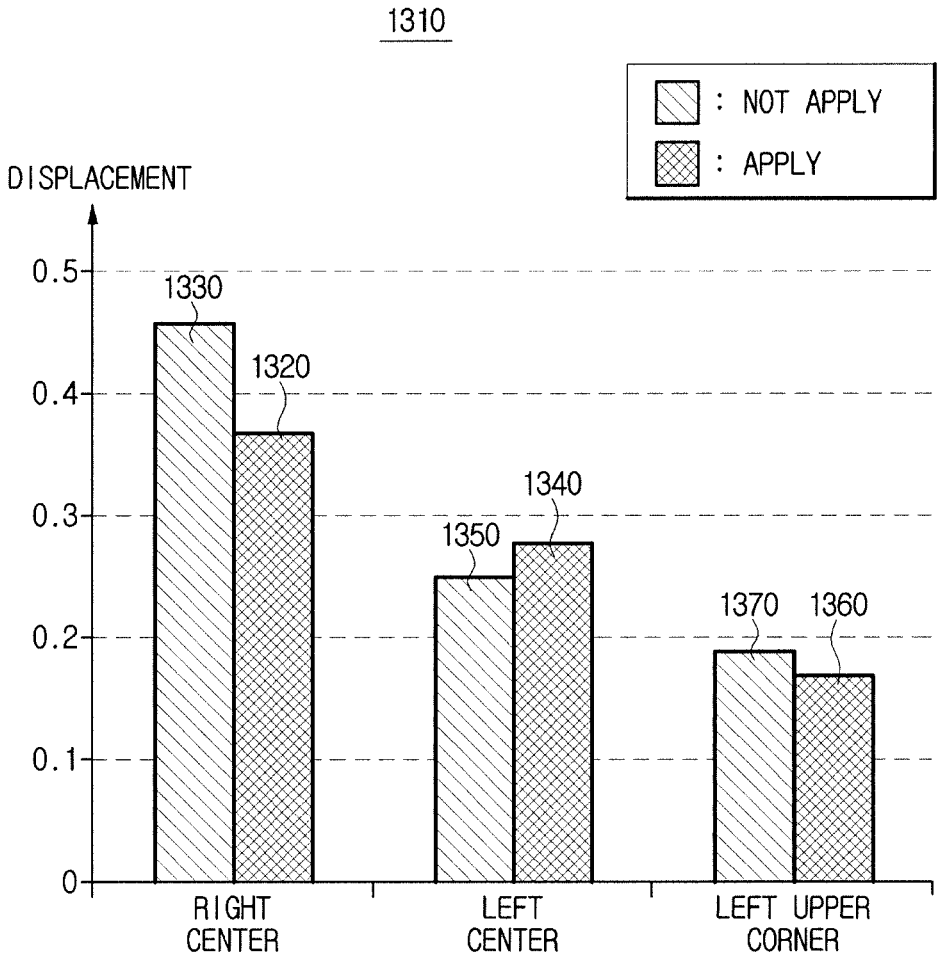
FIG. 13 is a graph for comparing a case in which the washing machine according to the embodiment includes the position guide apparatus to a case in which the washing machine includes no position guide apparatus.

FIG. 13 is a graph for comparing a case in which the washing machine according to the embodiment includes the position guide apparatus to a case in which the washing machine includes no position guide apparatus.

Referring to FIG. 13, in a graph 1310, the X-axis represents cases 1320, 1340, and 1360 in which the position guide apparatus is installed according to locations of the cabinet (for example, the cabinet 12 of FIG. 1) at which vibrations are measured and cases 1330, 1350, and 1370 in which no position guide apparatus is installed, and the Y-axis represents displacements of the cabinet 12. The graph 1310 shows results of measurement through an experiment of rotating the washing drum (for example, the washing drum 22 of FIG. 2) at 800 rpm after installing a weight of 1.0 kg inside the washing drum 22.

According to an embodiment, with respect to an upper center portion of the cabinet 22, in the case 1330 in which no position guide apparatus is installed, the cabinet 12 may vibrate to 0.46 mm in the left and right directions. In the case 1320 in which the position guide apparatus is installed, the cabinet 12 may vibrate to 0.37 mm in the left and right directions. Compared to the case 1330 in which no position guide apparatus is installed, the vibrations of the cabinet 12 may be reduced by 19%.

With respect to a left center portion of the cabinet 12, in the case 1350 in which no position guide apparatus is installed, the cabinet 12 may vibrate to 0.25 mm in the left and right directions. In the case 1340 in which the position guide apparatus is installed, the cabinet 12 may vibrate to 0.28 mm in the left and right directions. Compared to the case 1350 in which no position guide apparatus is installed, the vibrations of the cabinet 12 may increase by 12%.

With respect to a left upper portion of the cabinet 12, in the case 1370 in which no position guide apparatus is installed, the cabinet 12 may vibrate to 0.19 mm in the left and right directions. In the case 1360 in which the position guide apparatus is installed, the cabinet 12 may vibrate to 0.17 mm in the left and right directions. Compared to the case 1370 in which no position guide apparatus is installed, the vibrations of the cabinet 12 may be reduced by 10%.

Comparing the cases 1320, 1340, and 1360 in which the position guide apparatus is installed at various locations of the cabinet 12 to the cases 1330, 1350, and 1370 in which no position guide apparatus is installed, it can be seen that the vibration of the cabinet 12 increases or decreases after the position guide apparatus 100 is installed. However, the vibration of the cabinet 12 may have no great difference from a typical level of vibration. That is, installing the position guide apparatus 100 may have no great influence on the vibration of the cabinet 12.

As such, during the steady section, the position guide apparatus 100 may not transfer vibrations generated from the tub 21 to the suspension bar 54, and accordingly, the position guide apparatus 100 may not transfer vibrations generated from the tub 21 to the cabinet 12 connected to the suspension bar 54.

Figure 14:
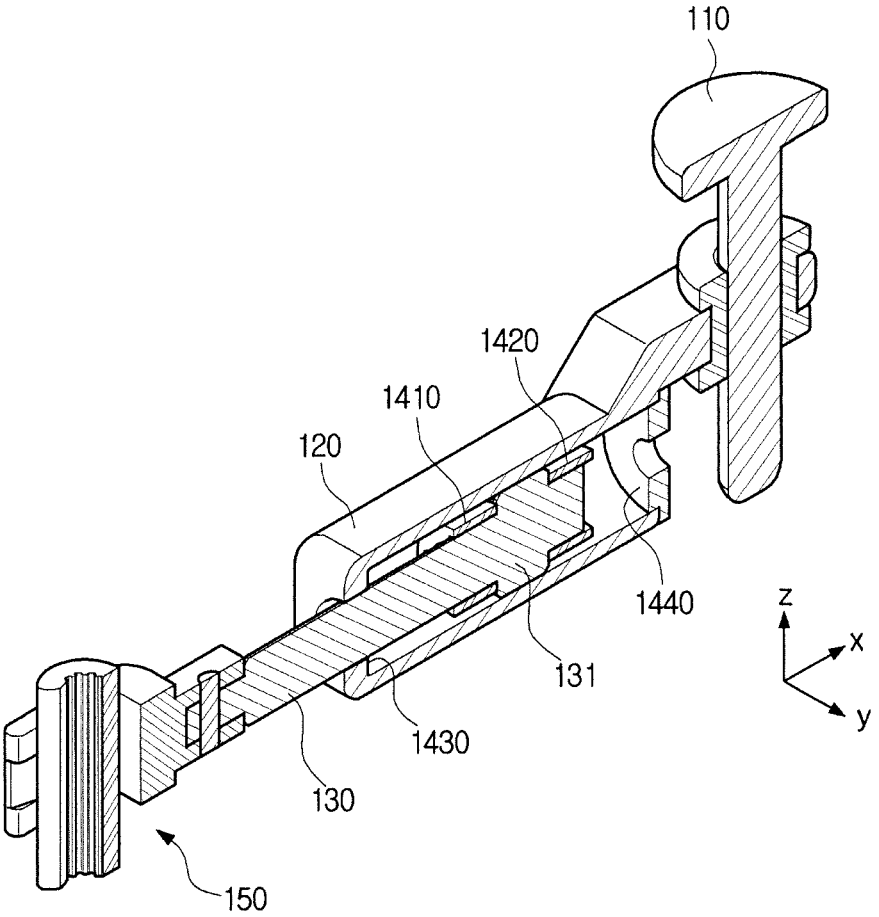
FIG. 14 is a perspective view showing another embodiment of a position guide apparatus included in a washing machine according to an embodiment of the present disclosure.

FIG. 14 is a perspective view showing another embodiment of a position guide apparatus included in a washing machine according to an embodiment of the present disclosure.

The basic configuration of the position guide apparatus has been described above with reference to FIGS. 5 and 6. Accordingly, redundant descriptions will be omitted, and differences between the position guide apparatus and the above-described position guide apparatus will be described.

According to an embodiment, the stopper 130 may include a first absorption member 1410 and a second absorption member 1420. Both the first absorption member 1410 and the second absorption member 1420 may be located in the inside of the cylinder 120. The first absorption member 1410 and the second absorption member 1420 may be respectively located before and behind the catching portion 131.

According to an embodiment, since both the absorption members 1410 and 1420 are located in the inside of the cylinder 120, it is possible to prevent cases in which the performance of the absorption members 1410 and 1420 deteriorates or the absorption members 1410 and 1420 are damaged due to outside moisture, etc. The absorption members 1410 and 1420 may be made of, for example, rubber or silicon. The absorption members 1410 and 1420 may reduce impact noise generated when the stopper 130 moves linearly along the stopper inserting hole 122 to contact the cylinder 120

A situation in which the first absorption member 140 approaches close to a first inner wall 1430 of the cylinder 120 may be a case in which the position guide apparatus 100 lengthens, and a situation in which the second absorption member 1420 approaches close to a second inner wall 1440 of the cylinder 120 may be a case in which the position guide apparatus 100 shortens.

Figure 15A:
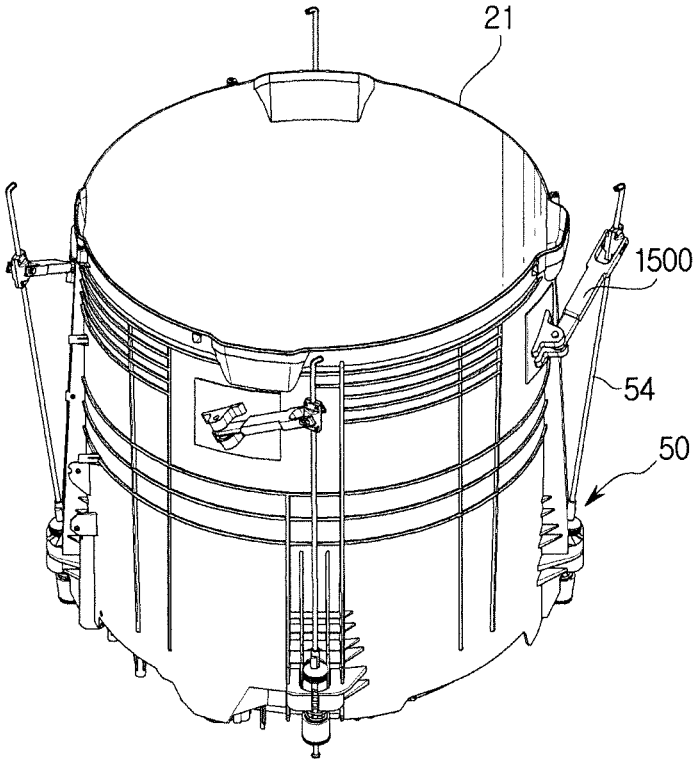
FIGS. 15A and 15B show a tub, a suspension apparatus, and a position guide apparatus of a washing machine according to another embodiment of the present disclosure.
Figure 15B:
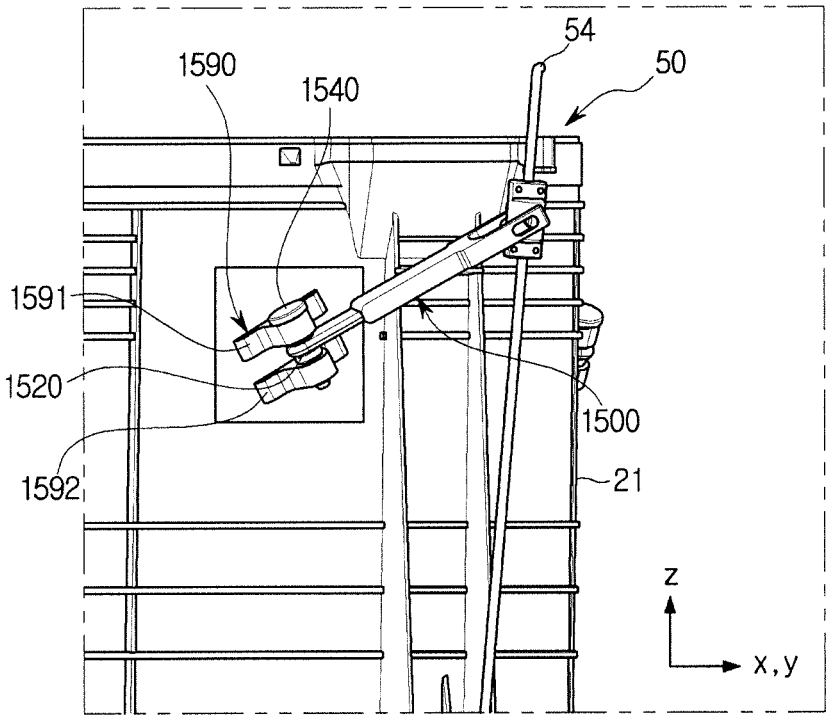

FIGS. 15A and 15B show a tub, a suspension apparatus, and a position guide apparatus of a washing machine according to another embodiment of the present disclosure.

The tub and the suspension apparatus shown in FIG. 15A are the same as the tub 21 and the suspension apparatus 50 described above with reference to FIG. 3, and accordingly, detailed descriptions thereof will be omitted.

Referring to FIG. 15A, a position guide apparatus 1500 may be installed at a location that is similar to that of the position guide apparatus 100 described above with reference to FIG. 3. At least one position guide apparatus 1500 may be installed on the outer surface of the tub 21.

One end of the position guide apparatus 1500 may be installed on the tub 21, and the other end of the position guide apparatus 1500 may be connected to an area of the suspension bar 54 included in the suspension apparatus 50.

FIG. 15B is a side view showing the tub 21, the suspension apparatus 50, and the position guide apparatus 1500 of the washing machine (for example, the washing machine 1 of FIG. 1).

Referring to FIG. 15B, the position guide apparatus 1500 may be coupled with the tub 21 using a tub coupling rod 1540. For example, the position guide apparatus 1500 may be coupled with the tub 21 by inserting the tub coupling rod 1540 into a tub coupling rod inserting hole 1520 formed in one end of the position guide apparatus 1500 at a position guide apparatus coupling portion 1590.

More specifically, the position guide apparatus coupling portion 1590 may include a first member 1591 and a second member 1592 respectively having holes into which the tub coupling rod 1540 can be inserted. The tub coupling rod inserting hole 1520 of the position guide apparatus 1500 may be located between the first member 1591 and the second member 1592 of the position guide apparatus coupling portion 1590, and the tub coupling rod 1540 may be inserted into the first member 1591, the tub coupling rod inserting hole 1520, and the second member 1592 so that the position guide apparatus 1500 can be coupled with the tub 21.

The first member 1591 and the second member 1592 may be coupled with the outer surface of the tub 21 at an angle of 20 degrees to 40 degrees on the XY plane. Accordingly, the position guide apparatus 1500 inserted between the first member 1591 and the second member 1592 and coupled with the position guide apparatus coupling apparatus 1590 may also be coupled with the tub 21 at the angle of 20 degrees to 40 degrees on the XY plane.

Figure 16A:
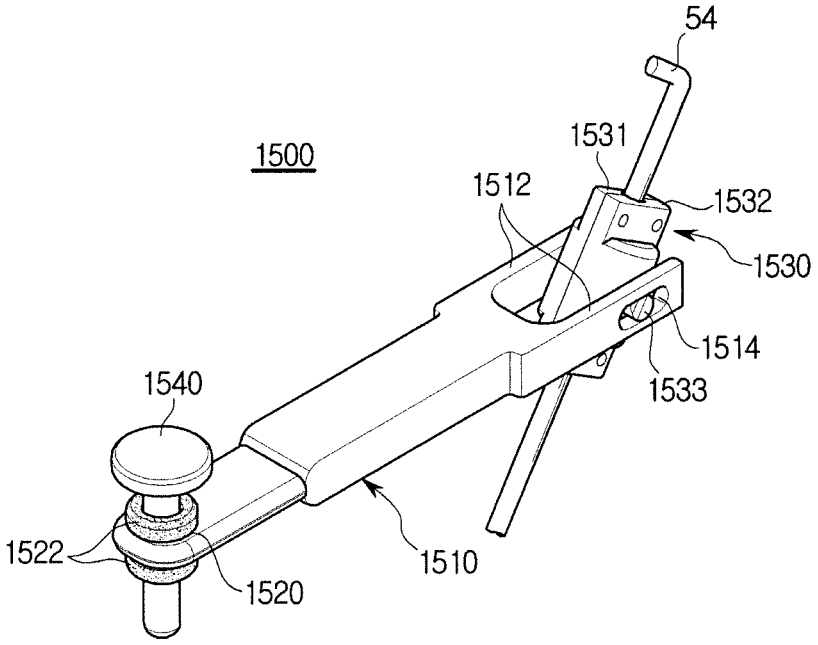
FIGS. 16A and 16B show a position guide apparatus according to an embodiment of the present disclosure.
Figure 16B:
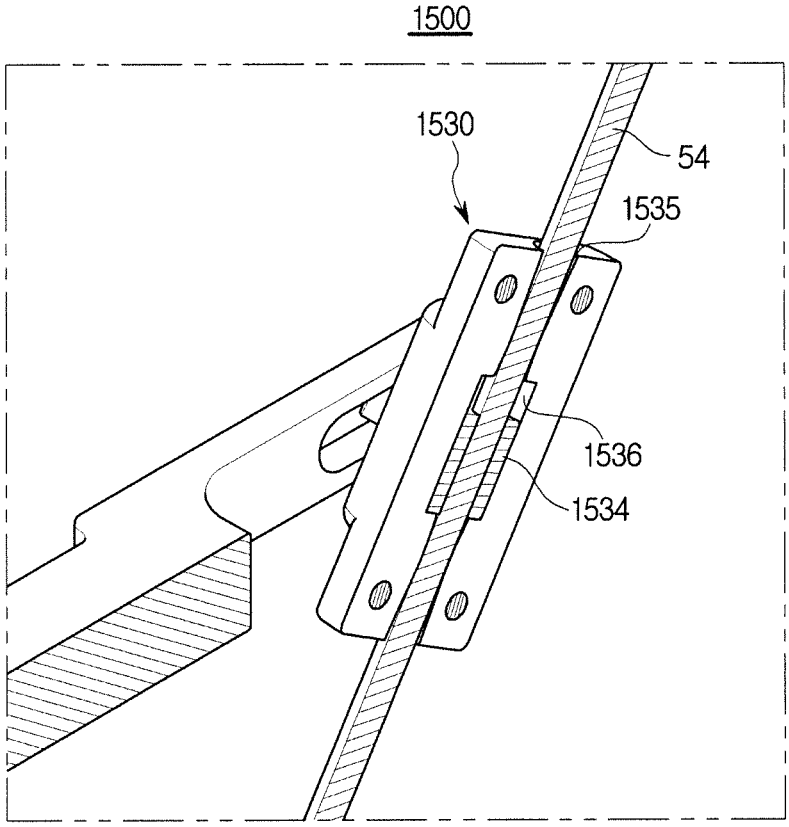

FIGS. 16A and 16B show a position guide apparatus according to an embodiment of the present disclosure.

FIG. 16A is a perspective view of the position guide apparatus 1500. FIG. 16B is a cross-sectional view of the position guide apparatus 1500.

Referring to FIG. 16A, the position guide apparatus 1500 may include a transversely moving portion 1510 and a longitudinally moving portion 1530.

According to an embodiment, one end of the transversely moving portion 1510 may include a pair of arms 1512. The pair of arms 1512 may include openings 1514, respectively. The openings 1514 may extend in a direction toward the arms 1512 from a center of the transversely moving portion 1510.

The longitudinally moving portion 1530 may be coupled with the transversely moving portion 1510 through the openings 1514 formed in the arms 1512. For example, by inserting a pair of protrusions 1533 formed on the outer surface of the longitudinally moving portion 1530 into the openings 1514 of the transversely moving portion 1510, the longitudinally moving portion 1510 can be coupled with the transversely moving portion 1510.

The other end of the transversely moving portion 1510 may include a tub coupling rod inserting hole 1520 for coupling with the tub 21. According to an embodiment, the transversely moving portion 1510 may have a thinner thickness or a narrower width at an area in which the tub coupling rod inserting hole 1520 of the transversely moving portion 1510 is formed, than the other area.

The transversely moving portion 1510 may be coupled with the tub 21 using the tub coupling rod 1540. For example, referring to FIG. 15B, the tub coupling rod inserting hole 1520 of the transversely moving portion 1510 may be positioned between the first member 1591 and the second member 1592 of the position guide apparatus coupling portion 1590. In this state, the tub coupling rod 1540 may be inserted in the order of the first member 1591 of the position guide apparatus coupling portion 1590, the tub coupling rod inserting hole 1520, and the second member 1592 of the position guide apparatus coupling portion 1590. Thereby, the transversely moving portion 1510 may be coupled with the tub 21 in such a way to be rotatable on the tub coupling rod 1540.

According to an embodiment, a rubber bearing 1522 may be disposed between the tub coupling rob 1540 and the tub coupling rob inserting hole 1520. The rubber bearing 1522 may reduce a friction force that is generated when the transversely moving portion 1510 rotates on the tub coupling rod 1540.

Referring to FIG. 16B, a friction member 1534 may be included in the inside of the transversely moving portion 1530. The transversely moving portion 1530 may provide a suspension bar inserting passage 1535 into which the suspension bar 54 can be inserted through coupling of a first member 1531 and a second member 1532. Thereby, the transversely moving portion 1530 may move along the suspension bar 54.

According to an embodiment, the transversely moving portion 1530 may provide a friction member inserting space 1536 surrounding an area of the suspension bar inserting passage 1535. For example, the friction member inserting space 1536 may be formed in the inside of the transversely moving portion 1530 such that the diameter of the friction member inserting space 1536 is greater than that of the suspension bar inserting passage 1535 having a circular cross section.

The friction member 1534 may be filled in at least one area of the friction member inserting space 1536. The friction member 1534 may be disposed in the friction member inserting space 1536 in such a way to surround a part of the suspension bar 54. If the suspension bar 54 is inserted into the longitudinally moving portion 1530, the friction member 1534 may contact the suspension bar 54. Thereby, when the longitudinally moving portion 1530 moves along the suspension bar 54, kinetic energy of the longitudinally moving portion 1530 can be reduced by a friction force that is generated between the friction member 1534 and the suspension bar 54. That is, a movement distance of the longitudinally moving portion 1530 can be reduced compared to when no friction member 1534 exists.

According to an embodiment, the friction member 1534 may be filled in the friction member insertion space 1536 without being fixed. Also, the friction member 1534 may be filled in an area of the friction member inserting portion 1536.

In this case, for example, when the longitudinally moving portion 1530 moves downward along the suspension bar 54, the friction member 1534 may contact the suspension bar 54 so as not to move in the friction member inserting space 1536. In this case, the longitudinally moving portion 1530 can move without any limitation due to a friction force of the friction member 1534.

If the longitudinally moving portion 1530 continues to move downward along the suspension bar 54 until the friction member 1534 contacts an inner end of the friction member inserting space 1536, the friction member 1534 may move together with the longitudinally moving portion 1530. In this case, the longitudinally moving portion 1530 may be limited in moving due to a friction force generated between the friction member 1534 and the suspension bar 54. As a result, a movement distance of the longitudinally moving portion 1530 may be reduced compared to when no friction member 1534 exists. A distance to which the longitudinally moving portion 1530 can move without any limitation due to a friction force between the friction member 1534 and the suspension bar 54 may depend on a length of an area in which the friction member 1534 is not filled in the friction member inserting space 1536.

FIGS. 17A, 17B, 17C, and 17D are views for describing movements of the tub when the washing machine according to the embodiment of the present disclosure performs a washing course.

If a washing course starts, the tub 21 may move in the left and right directions (in X- and Y-axis directions).

More specifically, if the washing machine (for example, the washing machine 1 of FIG. 1) starts a dehydration course, the washing machine 1 may rotate the washing drum (for example, the washing drum 22 of FIG. 2). The washing machine 1 may increase the RPM of the washing drum 22 gradually. For example, the washing machine 1 may increase the RPM of the washing drum 22 from 0 rpm to 800 rpm. A section for which the washing machine 1 gradually increases the RPM of the washing drum 22 may be defined as, for example, a transient section.

If the RPM of the washing drum 22 reaches about 100 rpm, the tub 21 may move in the left and right directions on the XY plane.

Figure 17A:
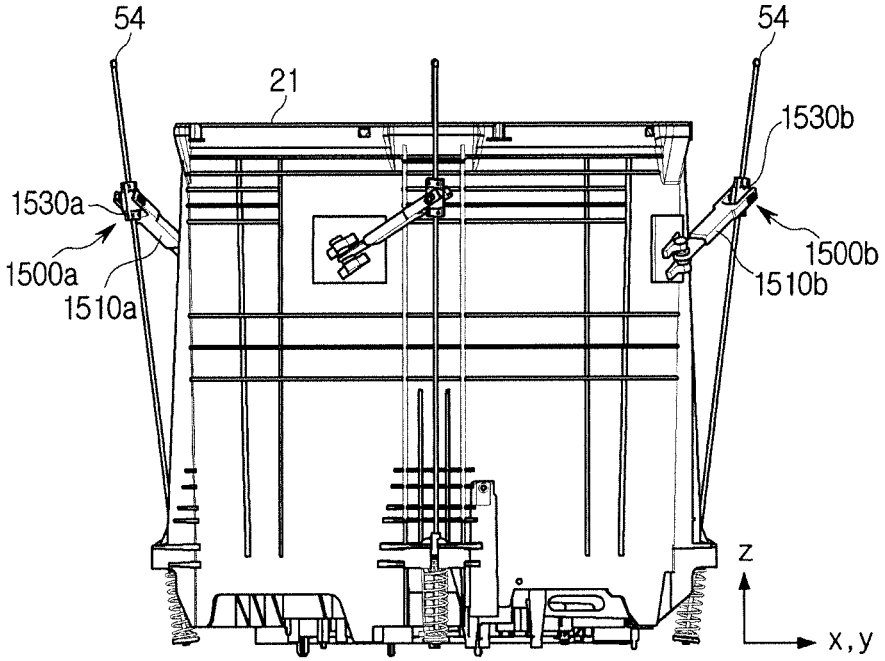
FIGS. 17A, 17B, 17C, and 17D are views for describing movements of the tub when the washing machine according to the embodiment of the present disclosure performs a washing course.

FIG. 17A shows positions of the tub 21, the position guide apparatus (that is, a first position guide apparatus 1500*a* and a second position guide apparatus 1500*b*) 1500, and the suspension apparatus 50 before a movement occurs. Hereinafter, movements of the position guide apparatus 1500 will be described using the first position guide apparatus 1500*a* and the second position guide apparatus 1500*b*.

Figure 17B:
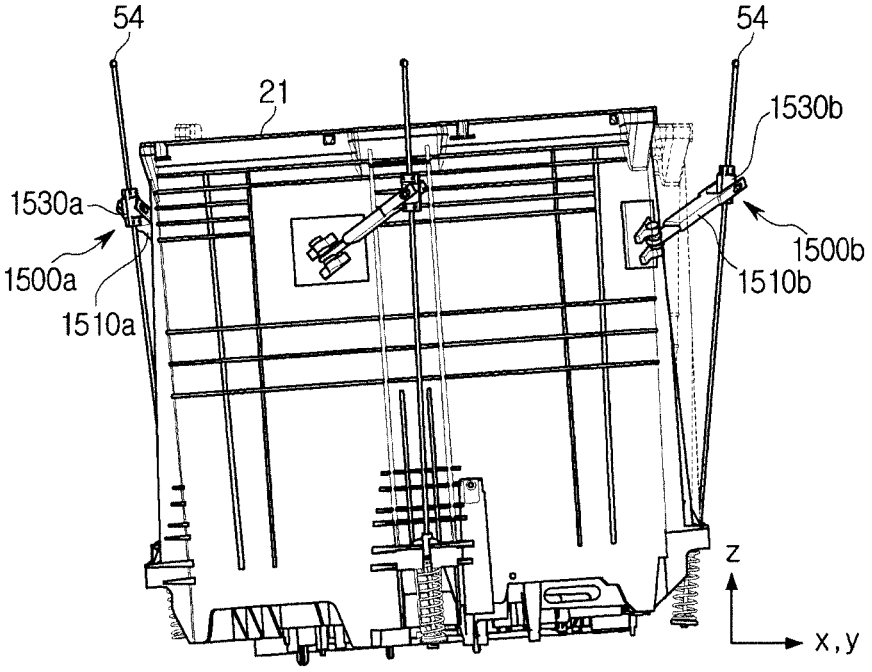

FIG. 17B shows a case in which the tub 21 moves in the positive (+) X-axis direction.

Referring to FIGS. 17A and 17B, if the tub 21 moves, the first position guide apparatus 1500*a* and the second position guide apparatus 1500*b* coupled with the tub 21 may move. For example, if a transversely moving portion 1510*a* included in the first position guide apparatus 1500*a* may move in the positive (+) X-axis direction, and a longitudinally moving portion 1530*a* included in the first position guide apparatus 1500*a* may move downward (a negative (−) Z-axis direction) along the suspension bar 54.

Also, a transversely moving portion 1510*b* included in the second position guide apparatus 1500*b* may move in the positive (+) X-axis direction, and a longitudinally moving portion 1530*b* included in the second position guide apparatus 1500*b* may move upward (a positive (+) Z-axis direction) along the suspension bar 54.

During a washing course, the tub 21 may move up and down so that a rolling phenomenon in which the tub 21 rotates on the Z-axis can occur.

If the washing drum 22 starts rotating, the tub 21 may roll. For example, if the RPM of the washing drum 22 reaches about 250 rpm, the tub 21 may move up and down so that the tub 21 rotates on the Z-axis, and accordingly, a rolling phenomenon in which the upper portion of the tub 21 is tilted may occur. As a result, the tub 21 may move in the left and right directions (XY plane) and in the up and down directions (Z-axis).

Figure 17C:
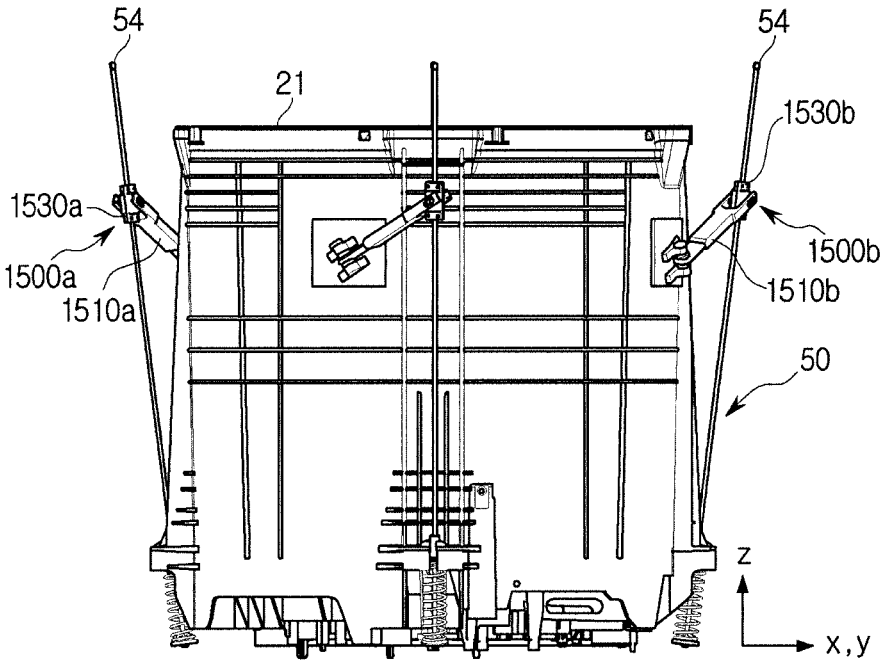

FIG. 17C shows positions of the tub 21, the position guide apparatus 1500, and the suspension bar 54 before a movement occurs.

Figure 17D:
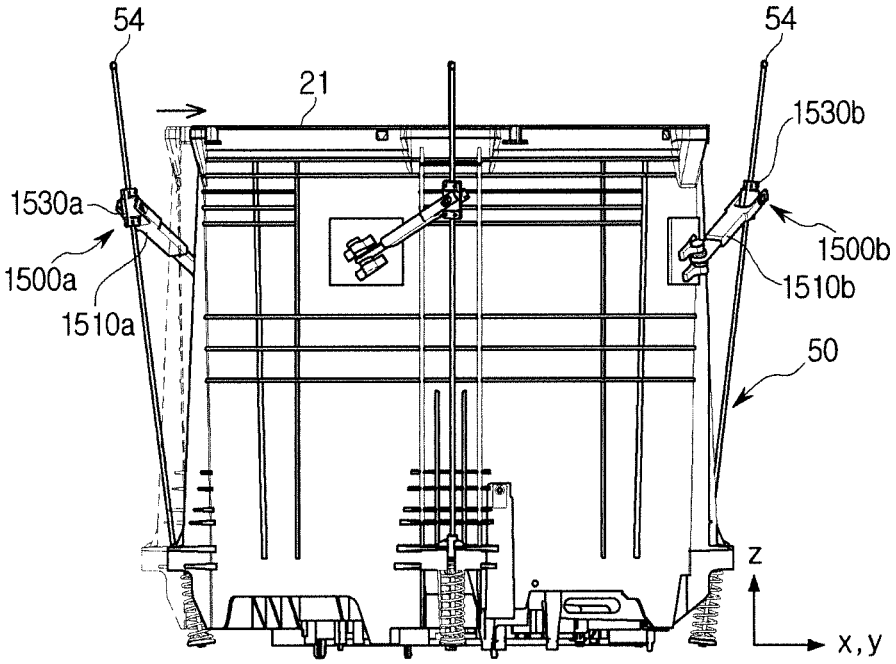

FIG. 17D shows a case in which the upper portion of the tub 21 is tilted to the left on the Z-axis.

Referring to FIGS. 17C and 17D, if the upper portion of the tub 21 is tilted, the first position guide apparatus 1500*a* and the second position guide apparatus 1500*b* coupled with the tub 21 may also move. For example, the transversely moving portion 1510*a* included in the first position guide apparatus 1500*a* may move in the negative (−) X-axis direction, and the longitudinally moving portion 1530*a* may move upward (positive (+) Z-axis direction) along the suspension bar 54.

Also, the transversely moving portion 1510*b* included in the second position guide apparatus 1500*b* may move in the negative (−) X-axis direction, and the longitudinally moving portion 1530*b* may move downward (negative (−) Z-axis direction) along the suspension bar 54.

As described above with reference to FIGS. 17A to 17D, the longitudinally moving portion 1530 included in the position guide apparatus 1500 may move along the suspension bar 54 according to a movement of the tub 21. At this time, a movement distance of the tub 21 may be reduced by the friction member 1534 included in the longitudinally moving portion 1530. That is, kinetic energy due to a movement of the tub 21 may be reduced by the position guide apparatus 1500. As a result, during the washing course, the tub 21 can be prevented from colliding with the cabinet 12 surrounding the tub 21.

Hereinafter, details about movements of the position guide apparatus 1500 for reducing movements of the tub 21 will be described.

FIGS. 18A, 18B, 18C, 18D, and 18E are views for describing a process in which a position guide apparatus according to an embodiment of the present disclosure reduces a movement distance of the tub.

Figure 18A:
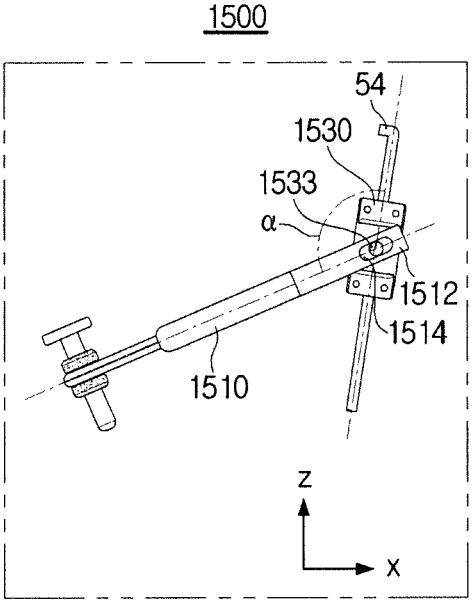
FIGS. 18A, 18B, 18C, 18D, and 18E are views for describing a process in which a position guide apparatus according to an embodiment of the present disclosure reduces a movement distance of the tub.

Referring to FIG. 18A, an angle α formed between the transversely moving portion 1510 coupled with the tub (for example, the tub 21 of FIG. 15) and the longitudinally moving portion 1530 coupled with the suspension bar 54 may exceed 90 degrees. For example, the angle α formed between the transversely moving portion 1510 and the longitudinally moving portion 1530 may be an angle between about 120 degrees and about 140 degrees.

If the transversely moving portion 1510 moves (for example, in the left and right directions), the longitudinally moving portion 1530 can easily move toward the upper or lower portion of the suspension bar 54 along the suspension bar 54 since the transversely moving portion 1510 and the longitudinally moving portion 1530 form an obtuse angle. That is, since the transversely moving portion 1510 and the longitudinally moving portion 1530 form an obtuse angle, it is possible to reduce a probability that the suspension bar 54 gets bent by the longitudinally moving portion 1530 when the transversely moving portion 1510 moves so that the longitudinally moving portion 1530 becomes immovable.

In order to cause the transversely moving portion 1510 and the longitudinally moving portion 1530 to form an obtuse angle, as described above with reference to FIGS. 15A and 15B, the first member 1591 and the second member 1592 of the position guide apparatus coupling portion 1590 between which the tub coupling rod inserting hole 1520 of the position guide apparatus 1500 is positioned may form an angle of 20 degrees to 40 degrees with respect to the X-axis.

FIG. 18A shows a state in which the tub 21 is immovable, like FIG. 17A. In this case, the protrusions 1533 formed on the outer surface of the longitudinally moving portion 1530 and inserted into the openings 1514 of the transversely moving portion 1510 may be positioned in the center of the openings 1514. That is, the protrusions 1533 may be in non-contact with one ends or the other ends of the inner surfaces of the openings 1514.

According to an embodiment, if the tub 21 moves in the positive (+) X-axis direction, the position guide apparatus 1500 may also move in the positive (+) X-axis direction.

Figure 18B:
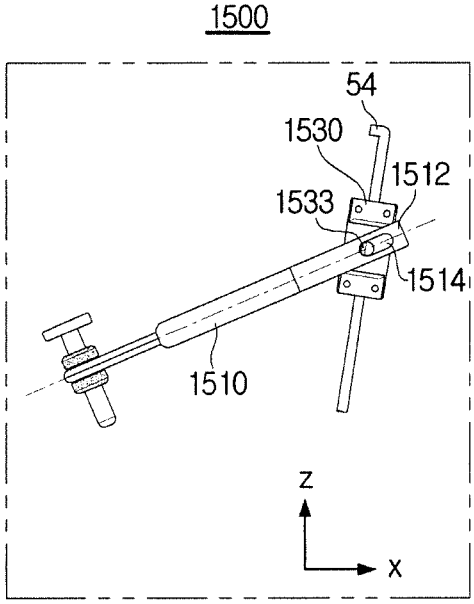

Referring to FIG. 18B, if the transversely moving portion 1510 of the position guide apparatus 1500 moves in the positive (+) X-axis direction, the protrusions 1533 formed on the outer surface of the longitudinally moving portion 1530 may contact one ends of the openings 1514 formed in the arms 1512 of the transversely moving portion 1510.

Figure 18C:
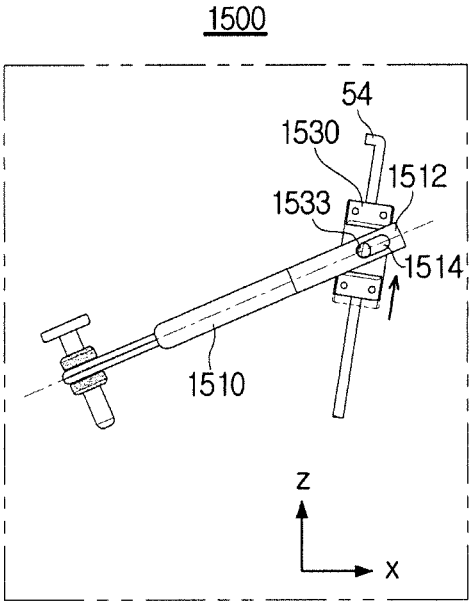

Referring to FIG. 18C, if the transversely moving portion 1510 of the position guide apparatus 1500 continues to move in the positive (+) X-axis direction, one ends of the openings 1414 may transfer kinetic energy generated by a movement of the tub 21 to the protrusions 1533. Due to the kinetic energy transferred to the protrusions 1533, the longitudinally moving portion 1530 may move to the upper portion of the suspension bar 54 along the suspension bar 54.

In this case, as described above with reference to FIG. 16B, the longitudinally moving portion 153 may include the friction member 1534 therein. The friction member 1534 may reduce the kinetic energy generated from the tub 21 and transferred to the longitudinally moving portion 1530. Accordingly, a movement distance of the tub 21 can be reduced compared to when no friction member 1534 exists, and the tub 21 can be prevented from colliding with the cabinet (for example, the cabinet 12 of FIG. 1) outside the tub 21.

According to another embodiment, if the tub 21 moves in the negative (−) X-axis direction, the position guide apparatus 1500 may also move in the negative (−) X-axis direction.

Figure 18D:
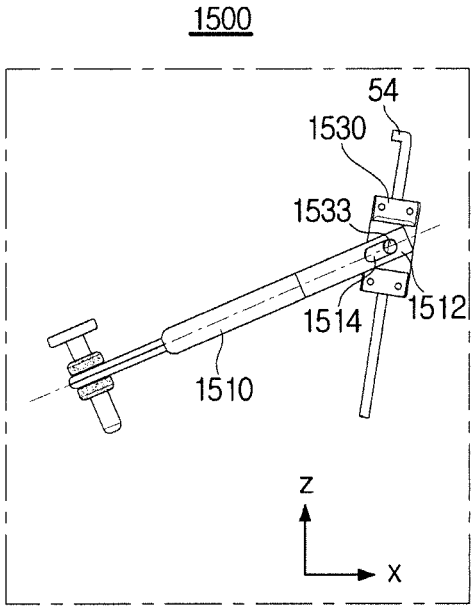

Referring to FIG. 18D, if the transversely moving portion 1510 of the position guide apparatus 1500 moves in the negative (−) X-axis direction, the protrusions 1533 formed on the outer surfaces of the longitudinally moving portion 1530 may contact the other ends of the openings 1514 formed in the arms 1512 of the transversely moving portion 1510.

Figure 18E:
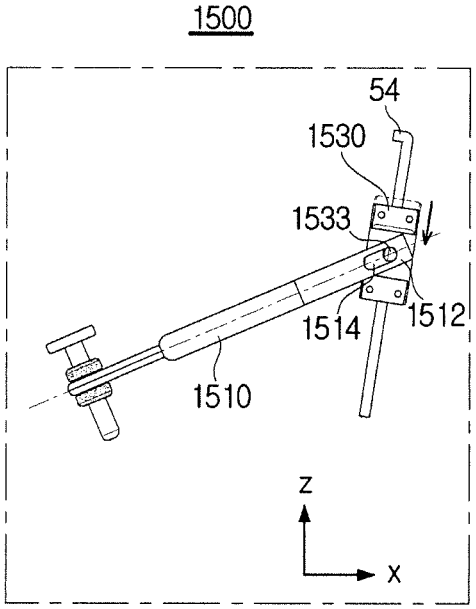

Referring to FIG. 18E, if the transversely moving portion 1510 of the position guide apparatus 1500 continues to move in the negative (−) X-axis direction, the other ends of the openings 1514 may transfer kinetic energy generated by the movement of the tub 21 to the protrusions 1533. Due to the kinetic energy transferred to the protrusions 1533, the longitudinally moving portion 1530 may move to the lower portion of the suspension bar 54 along the suspension bar 54.

In this case, as described above, the friction member 1534 may function to reduce the kinetic energy generated by the tub 21 and transferred to the longitudinally moving portion 1530. Accordingly, a movement distance of the tub 21 can be reduced compared to when no friction member 1534 exists, and the tub 21 can be prevented from colliding with the cabinet 12 outside the tub 21.

Figure 19A:
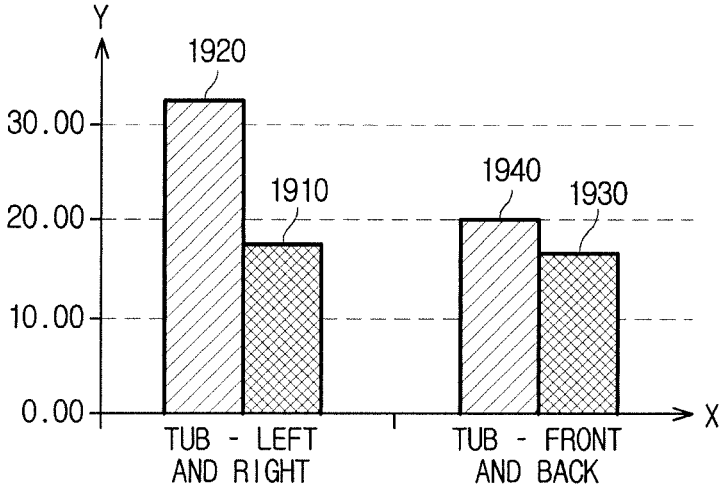
FIGS. 19A and 19B are graphs for comparing a case in which the position guide apparatus according to the embodiment is installed in the washing machine to a case in which no position guide apparatus is installed in the washing machine.
Figure 19B:
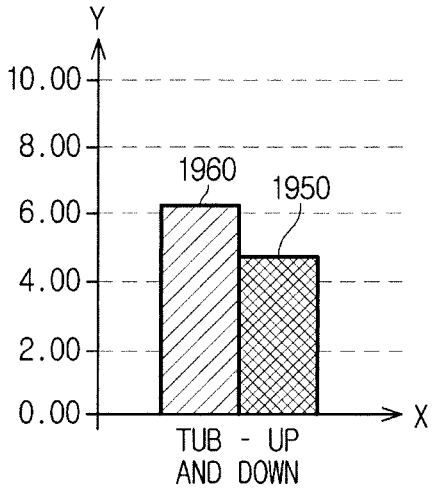

FIGS. 19A and 19B are graphs for comparing a case in which the position guide apparatus according to the embodiment is installed in the washing machine to a case in which no position guide apparatus is installed in the washing machine.

FIG. 19A is a graph for comparing movements in the X- and Y-axis directions, and FIG. 19B is a graph for comparing movements in the Z-axis direction.

In the graph of FIG. 19A, the X-axis represents a case 1910 in which the position guide apparatus is installed and a case 1920 in which no position guide apparatus is installed, and the Y-axis represents an amount of movement of the tub (for example, the tub 21 of FIG. 2). The graph of FIG. 19A shows results of measurement through an experiment of increasing the RPM of the washing drum (for example, the washing drum 22 of FIG. 2) from 0 rpm to 800 rpm after installing a weight of 1.2 kg inside the washing drum 22.

Referring to FIG. 19A, in the case 1920 in which no position guide apparatus is installed, the tub 21 may move to a distance of 32.5 mm in the left and right directions. In the case 1910 in which the position guide apparatus is installed, the tub 21 may move to a distance of 17.7 mm in the left and right directions. Compared to the case 1920 in which no position guide apparatus is installed, the movement distance of the tub 21 may be shortened by 14.8 mm in the left and right directions, resulting in a reduction rate of movement of 46%.

Referring to FIG. 19A, in the case 1940 in which no position guide apparatus is installed, the tub 21 may move to a distance of 20.2 mm in the front and back directions. In the case 1930 in which the position guide apparatus is installed, the tub 21 may move to a distance of 16.7 mm in the front and back directions. Compared to the case 1940 in which no position guide apparatus is installed, the movement distance of the tub 21 may be shortened by 3.5 mm in the front and back directions, resulting in a reduction rate of movement of 17%.

Referring to FIG. 19B, in a case 1960 in which no position guide apparatus is installed, the tub 21 may move to a distance of 6.3 mm in the up and down directions. In the case 1950 in which the position guide apparatus is installed, the tub 21 may move to a distance of 4.8 mm in the up and down directions. Compared to the case 1960 in which no position guide apparatus is installed, the movement distance of the tub 21 may be shortened by 1.5 mm in the up and down directions, resulting in a reduction rate of movement of 24%.

Figure 20:
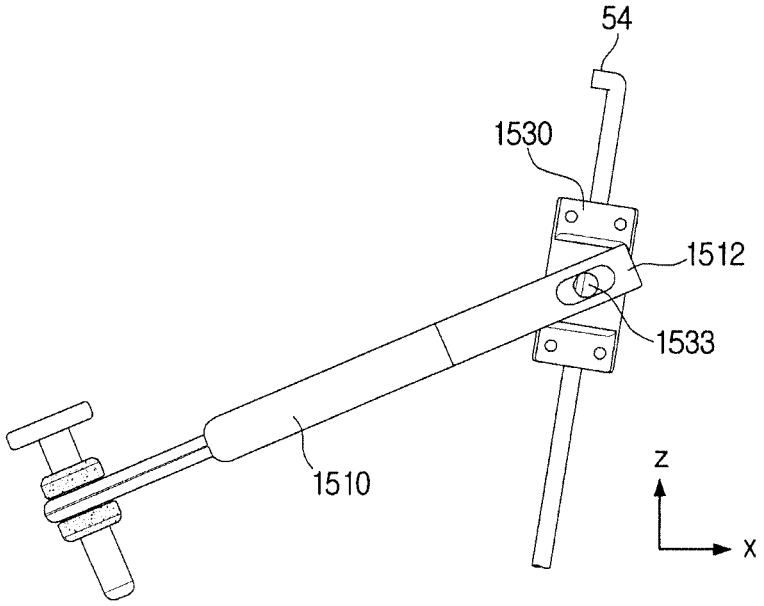
FIG. 20 is a view for describing a situation in which the position guide apparatus prevents vibrations of the tub from being transferred to the cabinet in the washing machine according to the embodiment of the present disclosure.

FIG. 20 is a view for describing a situation in which the position guide apparatus prevents vibrations of the tub from being transferred to the cabinet in the washing machine according to the embodiment of the present disclosure.

During a washing course, if the washing drum (for example, the washing machine 22 of FIG. 2) is maintained at 800 rpm, the movement of the tub 21 may be reduced. A section for which the washing drum 22 is maintained at constant RPM after a transient section elapses may be defined as a steady section.

During the steady section, a phenomenon in which the tub 21 moves in the left and right directions may be reduced, however, vibrations generated from the tub 21 may be transferred to the cabinet (for example, the cabinet 12 of FIG. 1) so that the cabinet 12 may vibrate.

At this time, the position guide apparatus 1500 may prevent vibrations of the tub 21 from being transferred to the cabinet 12.

Referring to FIG. 20, if the RPM of the washing machine 22 reaches 800 rpm, the protrusions 1533 of the longitudinally moving portion 1530 may move in the openings 1514 of the transversely moving portion 1510 without contacting one ends or the other ends of the openings 1514. In the insides of the openings 1514, no friction member for limiting the movements of the protrusions 1533 may exist. Accordingly, during the steady section, vibrations of the tub 21 may be not transferred to the longitudinally moving portion 1530. As a result, the position guide apparatus 1500 may not transfer vibrations of the tub 21 to the cabinet 12 connected to the suspension bar 54.

Figure 21:
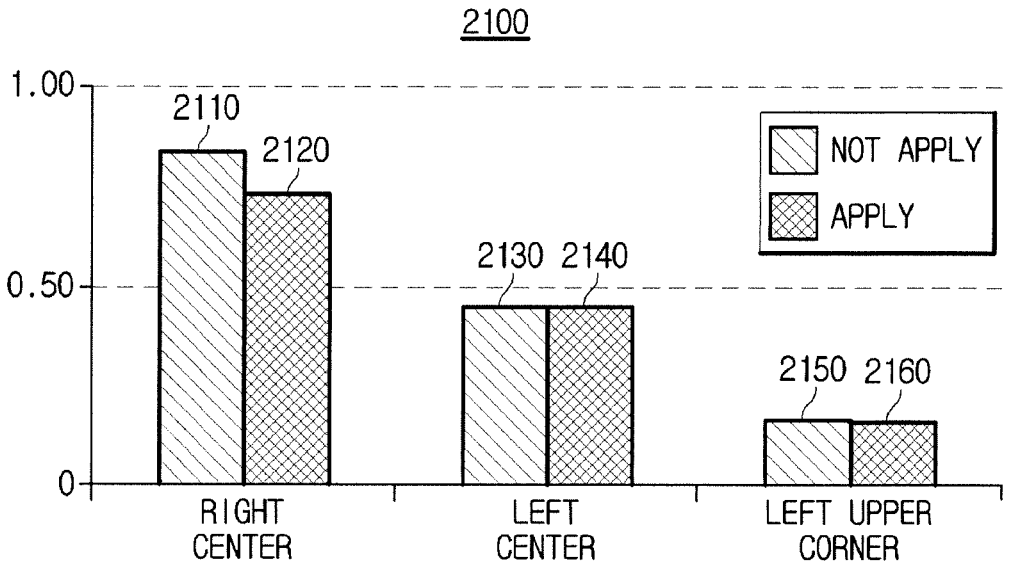
FIG. 21 is a graph for comparing a case in which the position guide apparatus is installed in the washing machine according to the embodiment to a case in which no position guide apparatus is installed in the washing machine.

FIG. 21 is a graph for comparing a case in which the position guide apparatus is installed in the washing machine according to the embodiment to a case in which no position guide apparatus is installed in the washing machine.

Referring to FIG. 21, in a graph 2100, the X-axis represents a case in which the position guide apparatus is installed, and a case in which no position guide apparatus is installed, according to positions of the cabinet (for example, the cabinet 12 of FIG. 1) from which vibrations are measured, and the Y-axis represents movement distances of the cabinet 12. The graph 2100 shows results of measurement through an experiment of rotating the washing drum (for example, the washing drum 22 of FIG. 2) at 800 rpm after installing a weight of 1.2 kg inside the washing drum 22.

According to an embodiment, in a case 2110 in which no position guide apparatus is installed, the cabinet 12 may vibrate to a distance of 0.84 mm in the left and right directions, with respect to a right center portion of the cabinet 12. In a case 2120 in which the position guide apparatus is installed, the cabinet 12 may vibrate to a distance to 0.73 mm in the left and right directions. Compared to the case 2110 in which no position guide apparatus is installed, vibrations of the cabinet 12 may be reduced by 13%.

In a case 2150 in which no position guide apparatus is installed, the cabinet 12 may vibrate to a distance of 0.16 mm in the left and right directions, with respect to a left upper corner of the cabinet 12. In a case 2160 in which the position guide apparatus is installed, the cabinet 12 may vibrate to a distance of 0.15 mm in the left and right directions. Compared to the case 2170 in which no position guide apparatus is installed, vibrations of the cabinet 12 may be reduced by 6%.

With respect to a left center portion of the cabinet 12, the same level of vibrations may be generated in both a case 2130 in which no position guide apparatus is installed and a case 2140 in which the position guide apparatus is installed.

As such, during the steady section, the position guide apparatus 1500 may not transfer vibrations generated from the tub 21 to the suspension bar 54, and accordingly, the position guide apparatus 1500 may also not transfer the vibrations generated from the tub 21 to the cabinet 12 connected to the suspension bar 54.

Figure 22:
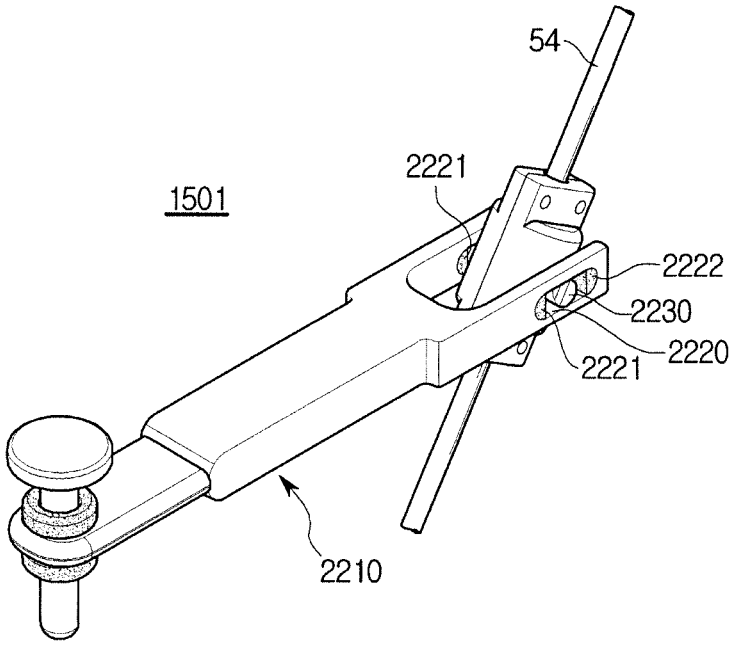
FIG. 22 is a perspective view showing another embodiment of a transversely moving portion included in the position guide apparatus according to the embodiment.

FIG. 22 is a perspective view showing another embodiment of a transversely moving portion included in the position guide apparatus according to the embodiment.

The basic configuration of a position guide apparatus 1501 according to another embodiment is the same as that of the position guide apparatus 1500 of FIG. 15, and accordingly, in the following description, differences between the position guide apparatus 1501 and the position guide apparatus 1500 will be described.

According to an embodiment, a first absorption member 2221 and a second absorption member 2222 may be disposed in one ends and the other ends of openings 2220 formed in a transversely moving portion 2210. The first absorption member 2221 and the second absorption member 2222 may be formed of, for example, rubber or silicon. The first absorption member 2221 and the second absorption member 2222 may cushion an impact that is generated when protrusions 2230 move along the openings 2220 to contact one ends and the other ends of the openings 2220.

Figure 23A:
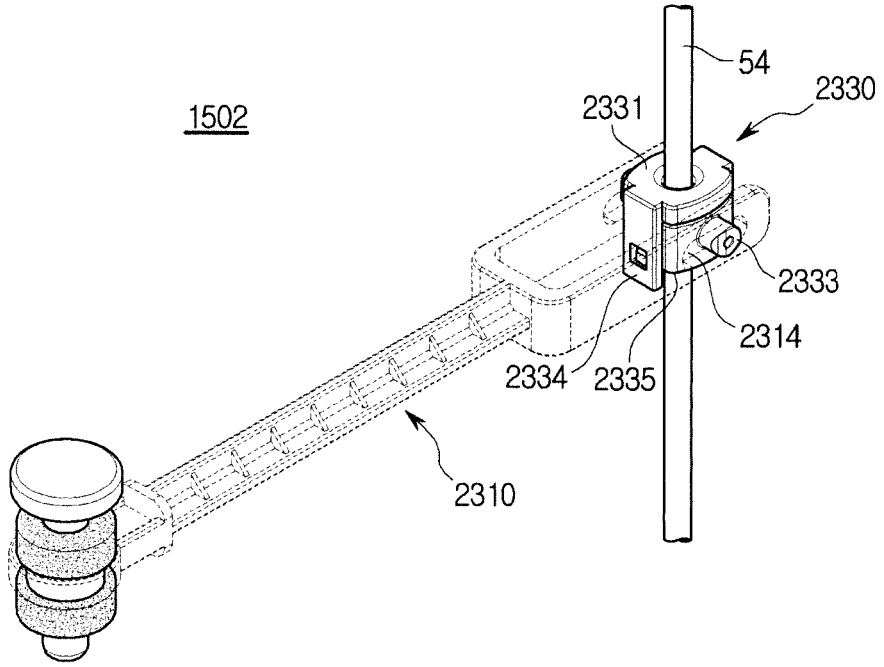
FIGS. 23A and 23B show another embodiment of a longitudinally moving portion included in the position guide apparatus according to the embodiment.
Figure 23B:
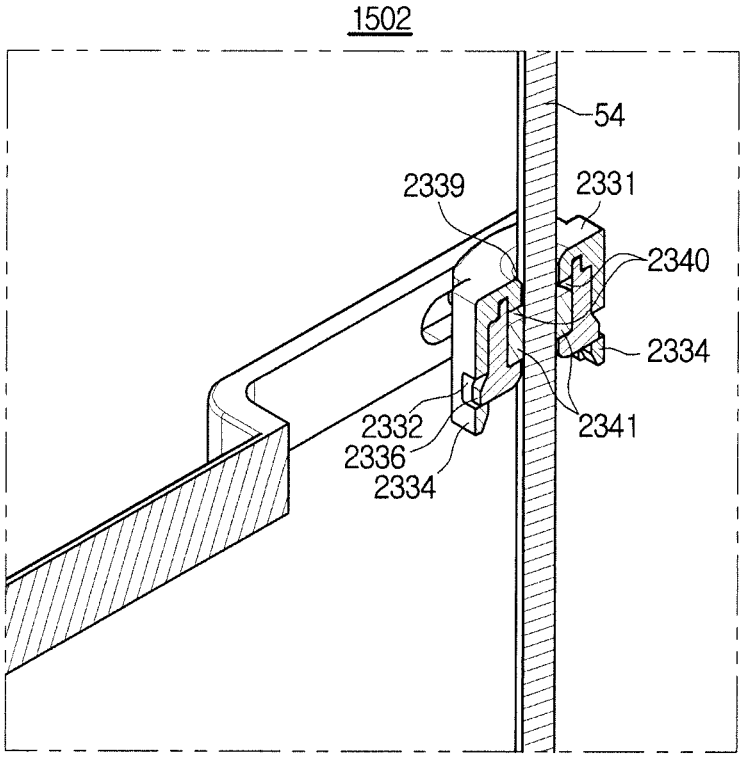

FIGS. 23A and 23B show another embodiment of a longitudinally moving portion included in the position guide apparatus according to the embodiment.

Referring to FIGS. 23A and 23B, a longitudinally moving portion 2330 according to another embodiment may have a structure configured by coupling a first member 2331 with a second member 2335 to form an insertion passage into which the suspension bar 54 can be inserted.

According to another embodiment, the first member 2331 may include a pair of arms 2334, and in the pair of arms 2334, a pair of catching grooves 2332 may be formed to be coupled with a pair of protrusions 2336 formed in the second member 2335.

The second member 2335 may be inserted between the pair of arms 2334 included in the first member 2331 so that the protrusions 2336 of the second member 2335 are coupled with the catching grooves 2332 of the first member 2331, and the first member 2331 is coupled with the second member 2335 to function as the longitudinally moving portion 2330.

A pair of protrusions 2333 may be formed on the outer surface of the second member 2335. The protrusions 2333 may be inserted into openings 2314 formed in a transversely moving portion 2310 to couple the longitudinally moving portion 2330 with the transversely moving portion 2310.

The longitudinally moving portion 2330 may include a friction member inserting space 2340 surrounding an area of a suspension bar inserting passage 2339 formed therein. That is, the friction member inserting space 2340 may be formed in the inside of the longitudinally moving portion 2330 such that the friction member inserting space 2340 has a diameter that is greater than that of the suspension bar inserting passage 2339 having a circular cross-section.

In at least one area of the friction member inserting space 2340, a friction member 2341 may be filled. The friction member 2341 may be disposed in the friction member inserting space 2340 to surround a part of the suspension bar 54. If the suspension bar 54 is inserted into the longitudinally moving portion 2330, the friction member 2341 may contact the suspension bar 54. Accordingly, when the longitudinally moving portion 2330 moves along the suspension bar 54, kinetic energy of the longitudinally moving portion 2330 can be reduced by a friction force of the friction member 2341. That is, a movement distance of the longitudinally moving portion 1530 can be reduced compared to when no friction member 2341 exists.

According to an embodiment, the friction member 2341 may be filled in the friction member inserting space 2340 without being fixed. Also, the friction member 2341 may be filled in an area of the friction member inserting space 2340.

In this case, for example, when the longitudinally moving portion 2330 moves downward along the suspension bar 54, the friction member 2341 may contact the suspension bar 54 so as not to move in the friction member inserting space 2340. In this case, the longitudinally moving portion 2330 can move without any limitation due to a friction force of the friction member 2341.

If the longitudinally moving portion 2330 continues to move downward along the suspension bar 54 until the friction member 2341 contacts an inner end of the friction member inserting space 2340, the friction member 2341 may move together with the longitudinally moving portion 2330. In this case, the longitudinally moving portion 2330 may be limited in moving due to a friction force generated between the friction member 2341 and the suspension bar 54. As a result, a movement distance of the longitudinally moving portion 2330 may be reduced compared to when no friction member 2341 exists.

The washing machine according to an embodiment of the present disclosure, which includes the cabinet, the tub disposed in the inside of the cabinet, the at least one suspension apparatus configured to reduce vibrations of the tub and connecting the tub to the cabinet such that the tub is supported on the cabinet, and the position guide apparatus whose one end is connected to the at least one suspension apparatus and whose other end is connected to the tub to limit a movement range of the tub, can limit movements of the tub, and prevent vibrations generated from the tub from being transferred to the cabinet.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a cabinet;

a tub disposed in the inside of the cabinet;

a suspension apparatus configured to reduce vibrations of the tub, and to connect the tub to the cabinet such that the tub is supported by the cabinet; and a position guide apparatus having one end connected to the suspension apparatus, and another end connected to the tub, and comprising:

a cylinder having an inside space, and a stopper having a portion located in the inside space of the cylinder, a portion located outside of the cylinder, a first absorption member made of rubber or silicon and disposed on the portion located in the inside space of the cylinder, and a second absorption member made of rubber or silicon and disposed on the portion located outside of the cylinder, wherein the cylinder is configured to be movable according to movement of the tub for a length that is based on a distance between the first absorption member and the second absorption member, and so that the position guide apparatus limits a movement range of the tub in a horizontal direction.

2. The washing machine according to claim 1, wherein the suspension apparatus includes a suspension bar, the stopper includes a catching portion at an end of the portion of the stopper located in the inside space of the cylinder, the position guide apparatus includes a suspension bar coupling portion provided at an end of the portion of the stopper located outside of the cylinder, and the suspension bar coupling portion is connected to the suspension bar.

3. The washing machine according to claim 2, further comprising:

a position guide apparatus coupling portion formed in an outer surface of the tub, wherein an end of the cylinder includes a stopper inserting hole into which the portion of the stopper located in the inside space of the cylinder is inserted, another end of the cylinder includes a tub fixing hole, and the position guide apparatus further includes a tub fixing portion that is configured to be inserted into the tub fixing hole such that ends of the tub fixing portion are rotatably coupled with the position guide apparatus coupling portion.

4. The washing machine according to claim 3, wherein the tub fixing portion is configured to be inserted into the cylinder such that the cylinder is rotatable on the tub fixing portion as a rotation shaft.

5. The washing machine according to claim 2, wherein the first absorption member is disposed adjacent to the catching portion, and the second absorption member is disposed adjacent to the suspension bar coupling portion.

6. The washing machine according to claim 2, wherein the suspension bar coupling portion includes a first member having a first accommodating space into which the stopper is configured to be inserted, and the suspension bar coupling portion further includes a second member having a second accommodating space into which the suspension bar is configured to be inserted.

7. The washing machine according to claim 6, wherein the second member further includes a protrusion, and the first member further includes a groove into which the protrusion of the second member is configured to be inserted so that the second member is coupled with the first member to be rotatable with respect to the first member using the protrusion as a rotation shaft.

8. The washing machine according to claim 6, wherein the second accommodating space is movable along the suspension bar.

9. The washing machine according to claim 1, wherein the cylinder is movable between a first position at which the cylinder contacts the first absorption member and a second position at which the cylinder contacts the second absorption member.

10. The washing machine according to claim 1, wherein the position guide apparatus is configured to limit a distance between the suspension apparatus and the tub to a predetermined distance.

11. A washing machine comprising:

a cabinet;

a tub disposed in the inside of the cabinet;

a suspension bar configured to connect the tub to the cabinet such that the tub is supported by the cabinet; and a position guide apparatus including a transversely moving portion connected to the tub, a longitudinally moving portion connected to the suspension bar, and a friction member disposed in the inside of the longitudinally moving portion so as to surround the suspension bar, wherein friction member limits movement of the position guide apparatus when the longitudinally moving portion moves along the suspension bar, and wherein the transversely moving portion is inclined so that a first side of the transversely moving portion, which is coupled to the longitudinally moving portion, is positioned higher than a second side of the transversely moving portion, which is connected to the tub.

12. The washing machine according to claim 11, wherein the position guide apparatus further includes a pair of arms located at one end of the transversely moving portion, the position guide apparatus further includes a pair of protrusions located on an outer surface of the longitudinally moving portion, and the pair of protrusions are configured to be inserted into openings respectively located in the pair of arms so that the transversely moving portion is coupled with the longitudinally moving portion.

13. The washing machine according to claim 12, wherein in a case in which the position guide apparatus is coupled with the tub and the suspension bar, and the protrusions located on the outer surface of the longitudinally moving portion are inserted into and coupled with the openings located in the arms of the transversely moving portion, the transversely moving portion is coupled with the longitudinally moving portion such that the transversely moving portion and the longitudinally moving portion form an obtuse angle.

14. The washing machine according to claim 13, wherein the openings located in the arms of the transversely moving portion extend in a direction toward the pair of arms from a center of the transversely moving portion, and the openings include first absorption members respectively disposed in one ends of inner surfaces of the openings, and the openings further include second absorption members respectively disposed in other ends of the inner surfaces of the openings.

15. The washing machine according to claim 11, wherein the longitudinally moving portion includes a friction member inserting space therein, and the friction member is disposed in at least one area of the friction member inserting space.

16. The washing machine according to claim 15, wherein the friction member is movable in the friction member inserting space.

17. The washing machine according to claim 11, wherein the longitudinally moving portion includes a catching groove included in a first member having a hole to pass the suspension bar through, the catching groove being configured to be coupled with a protrusion included in a second member having a hole to pass the suspension bar through.

* * * * *